US009434496B2

(12) United States Patent
Sytema

(10) Patent No.: US 9,434,496 B2
(45) Date of Patent: Sep. 6, 2016

(54) SYSTEM FOR PACKAGING ITEMS IN A CUSTOM SIZED BOX

(71) Applicant: NEOPOST TECHNOLOGIES, Bagneux (FR)

(72) Inventor: Herman Sytema, Terhorne (NL)

(73) Assignee: NEOPOST TECHNOLOGIES, Bagneux (FR)

( * ) Notice: Subject to any disclaimer, the term of this patent is extended or adjusted under 35 U.S.C. 154(b) by 0 days.

(21) Appl. No.: 14/764,407

(22) PCT Filed: Jan. 30, 2013

(86) PCT No.: PCT/IB2013/050799

§ 371 (c)(1),
(2) Date: Jul. 29, 2015

(87) PCT Pub. No.: WO2014/118594

PCT Pub. Date: Aug. 7, 2014

(65) Prior Publication Data

US 2015/0360801 A1 Dec. 17, 2015

(30) Foreign Application Priority Data

Jan. 29, 2013 (WO) ..... PCT/EP2013/051704

(51) Int. Cl.
*B65B 59/02* (2006.01)
*B65B 5/06* (2006.01)
(Continued)

(52) U.S. Cl.
CPC ..... *B65B 59/02* (2013.01); *B31B 1/25* (2013.01); *B31B 1/52* (2013.01); *B65B 5/024* (2013.01);
(Continued)

(58) Field of Classification Search
CPC ..... B65B 5/06; B65B 5/024; B65B 43/10; B65B 43/52; B65B 43/305; B65B 49/16; B65B 57/10; B65B 59/10; B65B 2210/04; B65B 11/02; B31B 1/25; B31B 1/52; B31B 2201/145; B31B 2201/257; B31B 2201/267; B31B 2201/14; B31B 2201/147; B31B 2201/25; B31B 2201/2654; B31B 2201/2666; B31B 2203/084; B31B 3/44; B31B 3/46
USPC ..... 53/558, 563, 376.4, 564, 504; 493/79, 493/80, 163, 52, 162
See application file for complete search history.

(56) References Cited

U.S. PATENT DOCUMENTS 1,705,748 A * 3/1929 Bridgman ..... B31B 1/44 229/190
2,605,598 A * 8/1952 Mackenzie ..... B65B 11/02 53/207

(Continued)

FOREIGN PATENT DOCUMENTS

| | | |
|---|---|---|
| FR | 2 844 252 A1 | 3/2004 |
| WO | 03/078255 A1 | 9/2003 |
| WO | 2011/072253 A1 | 6/2011 |

OTHER PUBLICATIONS

International Search Report mailed May 21, 2014 for corresponding International Application No. PCT/IB2013/050799, 3 pages.

*Primary Examiner* — Gloria R Weeks
*Assistant Examiner* — Justin Citrin
(74) *Attorney, Agent, or Firm* — Seed IP Law Group PLLC

(57) ABSTRACT

A system for packaging items in a custom sized box comprises a blank forming apparatus for forming a custom sized blank and a box folding apparatus for folding a custom sized box from the custom sized blank. The box folding apparatus comprises a rectangular throat frame having an adjustable rectangular throat opening and a suction device with suction nozzles for sucking the bottom panel of the blank. A displacement device is provided for lowering the suction nozzles from a top position in which top surfaces of the suction nozzles lie in a plane supporting the blank towards a bottom position, thereby causing folding of the side and end panels of the blank with respect to the bottom panel as the blank is drawn through the throat opening.

22 Claims, 18 Drawing Sheets

(51) Int. Cl.

| | |
|---|---|
| ***B65B 49/16*** | (2006.01) |
| ***B65B 57/10*** | (2006.01) |
| ***B65B 43/10*** | (2006.01) |
| ***B65B 43/52*** | (2006.01) |
| ***B31B 1/25*** | (2006.01) |
| ***B31B 1/52*** | (2006.01) |
| ***B65D 5/66*** | (2006.01) |
| ***B65B 59/00*** | (2006.01) |
| ***B65B 5/02*** | (2006.01) |

(52) U.S. Cl.

CPC ..... *B65B 5/06* (2013.01); *B65B 43/10* (2013.01); *B65B 43/52* (2013.01); *B65B 49/16* (2013.01); *B65B 57/10* (2013.01); *B65B 59/00* (2013.01); *B65D 5/6664* (2013.01); *B31B 2201/145* (2013.01); *B31B 2201/257* (2013.01); *B31B 2201/267* (2013.01); *B31B 2203/084* (2013.01); *B65B 2210/04* (2013.01)

(56) References Cited

U.S. PATENT DOCUMENTS

| | | | | | |
|---|---|---|---|---|---|
| 3,513,757 | A * | 5/1970 | Frank | B31B 1/00 | 493/131 |
| 3,771,282 | A * | 11/1973 | Flanagan | B65B 11/22 | 53/207 |
| 5,991,041 | A * | 11/1999 | Woodworth | G01B 11/04 | 356/602 |
| 6,267,715 | B1 * | 7/2001 | Sass | B31B 1/52 | 493/119 |
| 7,509,789 | B2 * | 3/2009 | Scholtes | B31B 1/44 | 493/163 |
| 2008/0020916 | A1 | 1/2008 | Magnell | | |

* cited by examiner

SYSTEM FOR PACKAGING ITEMS IN A CUSTOM SIZED BOX

BACKGROUND

1. Technical Field

The invention relates to a system for packaging items in a custom sized box, the system comprising an operating device comprising a processing unit for controlling the operation of the system; a measurement device for measuring the dimensions of items to be packaged and for providing data indicative for the measured dimensions, the measurement device being communicatively connected to the operating device for providing data indicative for the measured dimensions to the operating device; a blank forming apparatus for forming a custom sized blank, the blank forming apparatus being communicatively connected to the operating device, the operating device controlling the blank forming apparatus for forming a custom sized blank at least based on the data indicative for the measured dimensions, said blank forming apparatus comprising score application means for applying score lines as folding lines between the respective panels, the score application means being communicatively connected to the operating device, the operating device controlling the operation of score application means at least based on the data indicative for the measured dimensions; and a box folding apparatus for folding a custom sized box from the custom sized blank, the box folding apparatus being communicatively connected to the operating device, the operating device controlling the box folding apparatus for folding the custom sized box from the custom sized blank.

2. Description of the Related Art

Such a system is for example known from WO-A1-2011/072253. In this known system items to be packaged are arranged on a resting device and an imaging component obtains images or other data related to such arrangement. Based on the images and/or data, dimensions of the arrangement may be determined and a custom sized packaging template, such as a box template, may be designed. The designed template may have dimensions suitable to enclose the items when arranged on the resting device. A packaging production machine may produce a box template, on-demand, after the box template has been designed based on the physical arrangement of items on the resting device. Although WO-A1-2011/072253 generally mentions packaging production machines it does not describe a packaging production machine in detail which is able to produce or erect a box from a custom sized blank. In addition WO-A1-2011/072253 does not describe details of a packaging production machine with which a custom sized blank can be folded into a box which ensures that products to be packaged which are placed on the blank before folding or erecting the box are correctly supported during folding or erecting, such that they do not fall or tumble which could make the folding impossible. Therefore a need exists in the art for a system for packaging items in a custom sized box comprising a box folding apparatus for folding custom sized boxes from custom sized blanks in an easy and versatile manner, which additionally provides the possibility of placing the items to be packaged onto the blank before it is folded.

BRIEF SUMMARY

It is therefore an object of the present invention to provide such a system for packaging items in a custom sized box comprising a box folding apparatus for folding custom sized boxes from custom sized blanks in an easy and versatile manner. In accordance with the invention at least part of this object is obtained by providing a system for packaging items in a custom sized box, the system comprising;

an operating device comprising a processing unit for controlling the operation of the system;

a measurement device for measuring the dimensions of items to be packaged and for providing data indicative for the measured dimensions, the measurement device being communicatively connected to the operating device for providing data indicative for the measured dimensions to the operating device;

a blank forming apparatus for forming a custom sized blank, the blank forming apparatus being communicatively connected to the operating device, the operating device controlling the blank forming apparatus for forming a custom sized blank at least based on the data indicative for the measured dimensions, said blank forming apparatus comprising score application means for applying score lines as folding lines between the respective panels and cutting means for applying cutouts between the respective panels, the score application means being communicatively connected to the operating device, the operating device controlling the operation of score application means at least based on the data indicative for the measured dimensions;

a box folding apparatus for folding a custom sized box from the custom sized blank, the box folding apparatus being communicatively connected to the operating device, the operating device controlling the box folding apparatus for folding the custom sized box from the custom sized blank; and transport means for transporting the items to be packaged onto the bottom panel of said custom sized box;

characterized in that the box folding apparatus comprises a first support surface for the custom sized blank, the first support surface comprising:

a rectangular throat frame having a rectangular throat opening, the throat frame being mounted on a horizontal second support surface and including two transverse folding elements positioned at a first distance from each other for transversely folding the custom sized blank, and two longitudinal folding elements positioned at a second distance from each other for longitudinally folding the custom sized blank, the transverse and longitudinal folding elements defining the rectangular throat opening and enclosing the entire circumference of the throat opening, the transverse folding elements each having a transverse folding element top surface positioned at a first height from the second support surface and the longitudinal folding elements each having a longitudinal folding element top surface positioned at a second height from the second support surface; the uppermost of the top surfaces forming a first support surface for supporting the custom sized blank; the transverse and longitudinal folding elements being positioned stationary in height with respect to the first support surface; wherein at least one of said first distance and said second distance is adjustable based on the data indicative for the measured dimensions; and in that the box folding apparatus further comprises:

a suction device having suction nozzles, preferably four suction nozzles, the suction device being communicatively connected to the operating device;

a displacement device for lowering, preferably simultaneously, said suction nozzles from a top position in which top surfaces of the suction nozzles lie in the plane of the first support surface towards a bottom position, and for simultaneously raising said suction nozzles from the bottom position to the top position, respectively; the displacement device being communicatively connected to the operating device, the operating device controlling the displacement device for controlling the lowering and raising of the suction nozzles, respectively;

the operating device controlling the blank forming apparatus for forming a custom sized blank having at least a rectangular bottom panel, rectangular side panels and rectangular end panels joined to the bottom panel, and rectangular corner panels joined to the end panels; the operating device controlling the displacement device for positioning the suction nozzles in the top position and for activating the suction nozzles for sucking the bottom panel of the custom sized blank to the suction nozzles; and for thereafter lowering the suction nozzles towards the bottom position thereby causing folding of the side and end panels with respect to the bottom panel.

By using a suction device with preferably four suction nozzles which can be activated to suck to the bottom panel supported on the rectangular throat frame, and by using a displacement device for preferably simultaneously lowering the suction nozzles with the bottom panel such that it passes through the throat frame a relatively simple system is provided for folding a custom sized blank, which can in addition easily be adapted to fold blanks of different sizes. In addition since the folding elements enclose the entire circumference of the throat opening items placed on the bottom panel are completely surrounded by the folding elements and even if during folding one or more of these items tumbles or changes it original place, they are confined within the throat opening by the folding elements. Thus it is possible to fold a box together with the items to be packaged in a correct way. Preferably each suction nozzle is mounted near one corner of the rectangular throat opening and within the rectangular throat opening.

In an embodiment of a system for packaging items in a custom sized box according to the invention which is in particular suitable for rapid adaptation to different sized blanks, the operating device is arranged for adjusting the first and second distance at least based on the data indicative for the measured dimensions. In order to make the construction of the system relatively simple especially with regard to placing and positioning items to be packaged on a bottom panel of a custom sized blank it is preferred that one of the transverse folding elements is positioned stationary. It is further preferable that near each corner of the throat frame a corner connection piece is provided, each corner connection piece having a transverse sliding sleeve slidably supporting a part of a transverse folding element and a longitudinal sliding sleeve slidably supporting a part of a longitudinal folding element. In this manner on the one hand a correct mutual connection between the transverse and longitudinal folding elements is guaranteed and on the other hand the distance between the elements, i.e., the dimensions of the throat opening, can easily be adjusted. In case each corner connection piece is provided with a vertical support element having a guide surface the (partly) folded custom sized blank can be laterally guided when the suction nozzles are lowered or raised by the displacement device. In addition the guide surfaces prevent that the (partly) folded panels return to their original flatter state.

In a further embodiment of a system for packaging items in a custom sized box according to the invention the suction nozzles are displaceable with respect to one another in a plane which is parallel to the first support surface. Since the four corners of the bottom panel form the corner parts of the final custom sized box, and these corner parts form the strongest parts of the bottom of the box, supporting of the bottom panel by the suction nozzles can be performed best when the suction nozzles are positioned near the corners of the throat frame. Since in this embodiment the suction nozzles are displaceable with respect to one another it can be arranged that the suction nozzles are placed in the corners of the throat frame irrespective of the dimensions thereof. Thus preferably the suction nozzles are displaceable together with the folding elements such that each maintains its relative positioning with respect to its respective corner of the throat opening. In an embodiment of a system for packaging items in a custom sized box in which this can be realized in a constructional simple manner each of the suction nozzles is slidably mounted on a vertical sliding rod mounted to a respective vertical support element, wherein preferably the displacement device comprises a central translation construction, the central translation construction comprising for each suction nozzle a shearing element construction which is at one end connected to a respective sliding rod and with the other end to a respective, centrally positioned sliding element, the four centrally positioned sliding elements being fixedly connected to each other.

In a still further embodiment of a system for packaging items in a custom sized box according to the invention each of the suction nozzles comprises multiple suction heads and/or additional supporting elements, wherein top surfaces of the additional supporting elements lie in the plane of the first support surface. In this way it is possible to guarantee that the suction nozzles correctly engage of the bottom panel of the custom sized blank independent of the material of which the blank is manufactured and that sufficient support is provided in case items to be packaged are placed on the bottom panel of the custom sized blank prior to folding the blank.

In another embodiment of a system for packaging items in a custom sized box according to the invention the system is further provided with corner panel folders mounted near the corners of the throat frame in positions to underlie the corner panels respectively, the operating device controlling the corner panel folders for folding the corner panels at least partly upwards after the suction nozzles have been activated for sucking the bottom panel of the custom sized blank to the suction nozzles and before the suction nozzles are lowered towards the bottom position. Since the corner panel folders are arranged to underlie the corner panels it is possible to transport or transfer a custom sized blank in an easy way to a position above the throat frame, after which the corner panel folders are activated to at least partly fold the corner panels upwards to ensure a reliable folding of the blank in a consistently correct order. Preferably the corner panel folders are moveable in a plane parallel to the first support surface, and wherein the operating device is arranged for moving the corner panel folders in positions to underlie the corner panels at least based on the data indicative for the measured dimensions. In case each corner panel folder is supported by a respective corner connection piece the corner panel folders can in a constructional simple but reliable manner be displaced in a plane parallel to the first support surface while maintaining a correct relationship with regard to the corners of the throat frame.

In a further embodiment of a system for packaging items in a custom sized box according to the invention the first height at which the transverse folding element top surface is positioned from the second support surface is larger than the second height at which the longitudinal folding element top surface is positioned from the second support surface. In this manner a correct folding order is ensured in which, after the corner panels have been folded upwards by the corner panel folders, during lowering of the bottom panel through the throat frame first the end panels are folded upwards by the transverse folding elements, after which the side panels are folded upwards by the longitudinal folding elements.

In a particularly advantageous embodiment of a system for packaging items in a custom sized box according to the invention in which the operating device controls the blank forming apparatus for forming a custom sized blank having a rectangular bottom panel, rectangular side panels and rectangular end panels joined to the bottom panel, rectangular corner panels joined to the end panels, a rectangular top panel joined to one of the end panels, rectangular top side panels joined to the top panel, a rectangular top end panel joined to the top panel and rectangular top corner panels joined to the top end panel, a closed custom sized boxed enclosing the items to be packaged can be erected from the custom sized blank. Such a closed custom sized box can easily be folded in an automated manner when the operating device controls the displacement device for further lowering the suction nozzles towards the bottom position thereby causing an initial folding of the rectangular top panel as the folding line between the end panel and the top panel is engaged by the respective transverse folding element. It is then in particular easy to complete the folding of the top panel over the bottom panel and the erected side and end panels when the system is provided with a top panel folder for folding the top panel over the bottom panel and the erected side and end panels, and when the operating device controls the top panel folder for folding the top panel after the suction nozzles have reached the bottom position. Preferably the bottom position is adjustable dependent on, preferably proportional to the height of the items to be packaged as measured by the measurement device.

For reliably and in a constructionally easy manner completing the custom sized box in an embodiment of a system for packaging items in a custom sized box according to the invention the top panel folder comprises a rectangular upper throat frame having a rectangular upper throat opening, the upper throat frame including at least one upper transverse folding element for transversely folding the top panel, two upper longitudinal folding elements positioned at the second distance from each other for longitudinally folding the top panel, the upper transverse and upper longitudinal folding elements defining the rectangular upper throat opening, the operating device controlling the top panel folder for positioning the upper throat frame in a folding position in which the upper transverse and upper longitudinal folding elements are positioned above the transverse and longitudinal folding elements after the top panel folder has folded the top panel over the bottom panel and the erected side and end panels, the upper transverse folding element having an upper transverse folding element bottom surface which in the folding position of the throat frame is positioned at a third height from the second support surface, the upper longitudinal folding elements each having an upper longitudinal folding element bottom surface which in the folding position of the throat frame is positioned at a fourth height from the second support surface; the operating device controlling the displacement device for raising the suction nozzles after the upper throat frame has been positioned in the folding position. To ensure a correct folding order in a constructional simple manner the upper throat frame includes two top corner panel folding elements mounted near two corners of the upper throat frame in positions to overlie the two top corner panels respectively, each of the top corner panel folding elements having a bottom surface which in the folding position of the throat frame is positioned at a fifth height from the second support surface, said fifth height being smaller than said third height and the third height being smaller than the fourth height. Preferably each top corner panel folding element is moveable in a plane parallel to the support plane, and wherein the operating device is arranged for moving the top corner panel folding elements in positions to overlie the top corner panels at least based on the data indicative for the measured dimensions. In analogy with a preferred construction of the throat frame supporting the bottom panel, which throat frame is also called lower throat frame, comprising corner connection pieces, near each corner of the upper throat frame an upper corner connection piece is provided, each corner connection piece having an upper transverse sliding sleeve slidably supporting a part of the upper transverse folding element and an upper longitudinal sliding sleeve supporting a part of an upper longitudinal folding element. In a particularly economic embodiment of a system for packaging items in a custom sized box according to the invention each top corner panel folding element is supported by a respective upper corner connection piece. In particular the second distance between the two upper longitudinal folding elements is adjustable, and wherein the operating device is arranged for adjusting the second distance at least based on the data indicative for the measured dimensions.

For keeping a folded custom sized box in shape the top panel folder comprises upper side guides. In this manner the box is kept in shape for further processing of the box.

In an embodiment of a system for packaging items in a custom sized box according to the invention wherein the operating device controls the blank forming apparatus for forming a custom sized blank in which the rectangular bottom panel has a length L and a width W, the rectangular side panels each have a length L and a width ½ H and the rectangular end panels each have a width W and a length H, the rectangular corner panels each have a length H and a width ½ H, the rectangular top panel has a length L and a width W, the rectangular top side panels have a length L and a width ½ H, the rectangular top end panel has a length ½ H and a width W, and the rectangular top corner panels have a width and a length of ½ H, it is possible to apply a single tape around the box to connect neighboring side panels to each other in order to seal the box. This allows the use of a relatively simple taping device applying tape to the box. Please note that the height, width and length can deviate a small amount from the measured dimensions depending on the material of which the blank is made and taking account of folding properties. In case the material is a relatively stiff material (which is harder to bend) it is preferred to add a few millimeters to these dimensions to ensure that after folding sufficient inner space is left inside the box. Preferably the system further comprises cutting means for providing cutouts between the corner panels and the adjoining side panels having a width of ½ H, the cutting means being communicatively connected to the operating device, the operating device controlling the operation of the cutting means at least based on the data indicative for the measured dimensions. In an alternative embodiment the top side panels have a width of ½ H+D and the top end panel has a length of ½ H+D, wherein D is about 1 cm to about 3 cm. In this way it is still realized that the position (i.e., height) at which a tape has to be provided on the box to seal it is the same around the box relative to the support such that the tape can be provided easily. Furthermore since the top side panels overlap the side panels with an amount of D it is ensured that opening of the box by breaking the tape, e.g., with a knife does not damage the items packaged inside the box. Since the height at which the box has to be sealed is correctly defined it is possible to use a tape having a tear strip or cord, so that opening the sealed box at a later stage by a customer can be performed very easy. Although a single tape surrounded the entire box can be used to seal the box, it is in alternative embodiments possible to use two or more tapes to seal the box. In addition these tapes need not necessarily surround the box completely.

In an embodiment of a system for packaging items in a custom sized box which operates in a largely automated manner the system comprises transferring means for transferring a custom sized blank onto the support and for positioning the rectangular bottom panel above the throat opening of the rectangular throat frame, the transferring means being communicatively connected to the operating device, the operating device controlling the operation of transferring means. In particular the transferring means transfer the custom sized blank such onto the support that a centerline of the bottom panel of the custom sized blank is positioned above a centerline of the support.

In an embodiment of a system for packaging items in a custom sized box according to the invention, the operating device is arranged for controlling the operation of transport means for transporting items of which the dimensions have been measured onto the bottom panel after the suction nozzles have been positioned in the top position and before the operating device controls the displacement device for lowering the suction nozzles. In an advantageous embodiment the inventive system comprises further transport means for transporting the completed box away from the box folding apparatus for further processing, which further transport means are controlled by the operating device. In a particular embodiment these further transport means comprises a movable support and a further transport conveyor, said movable support supporting the completed box with packaged items from the box folding apparatus to the further transport conveyor. Preferably the movement of the movable support is coupled to the movement of the upper throat frame. Preferably the operating device is arranged to calculate or deduce a footprint of the items to be packaged from the information supplied by the measurement device, said footprint having a centerline. The operating device then preferably controls the transport means such that the items to be packaged are positioned on the bottom panel such that the centerline of the footprint is positioned above the centerline of the bottom panel. The transport means preferably comprises weighing means for weighing each of the items to be packaged, said weighing means being communicatively connected to the operating device for supplying data indicative of the weight of an item to be packaged. Based on this information and on weight information of the custom sized blank, which can be calculated by the operating device based on the total surface area of the custom sized blank and the weight per surface area of the material used for the blank (which weight per surface area can e.g., be inputted manually in the operating device) the operating device can determine beforehand the total weight of the box including all items to be packaged. In case the inventive system comprises a weighing scale for weighing the completed box with the packaged items, then the operating device can perform a check whether the weight as measured by the weighing scale matches the weight calculated beforehand. In case there is a mismatch the operating device can provide a warning signal or can activate a diverter which diverts the completed box from the normal path of transport for further processing completed boxes. In a further embodiment of an inventive system the transport means for transporting items to be packaged onto the bottom panel may comprises a diverting transport conveyor for diverting items to be packaged from the path towards the bottom panel, said diverting transport conveyor being communicatively connected to the operating device in order to be controlled thereby. The operating device may activate the diverting transport conveyor e.g., in case the measured weight of the items to be packaged is larger than a previously set threshold value or in case one of the measured dimensions exceeds a previously set value for that dimension. In an advantageous embodiment the inventive system comprises a second box folding apparatus which is practically identical to the (first) box folding apparatus except that the second box folding apparatus is arranged to fold blanks having (much) larger dimensions then can possible be folded by the first box folding apparatus and/or arranged to package items of which the total weight exceeds a certain threshold value and/or to package items which, e.g., due to legal guidelines, have to be packaged under certain conditions (e.g., in a pressurized environment, which can be either overpressure or sub-atmospheric pressure) and/or with specified packaging material and/or wit specified filling material. This second box folding apparatus receives the items to be packaged preferably from the diverting transport conveyor.

In a further embodiment of a system for packaging items in a custom sized box according to the invention the blank forming apparatus comprises a shredder for shredding waist material originating from cutting the custom sized blank, and for supplying the shredded material to a buffer storage. The inventive system then preferably comprises a filling apparatus communicatively connected to the operating device for filling the partly folded box under control of the operating device before the top panel is folded over. In this way the box can be filled with waist material to protect the packaged items during transport. Preferably the buffer storage comprises sensors (e.g., weight or height sensors) communicatively connected to the operating device to provide information indicating whether or not the buffer storage comprises sufficient filling material, so that when needed additional actions can be taken.

To further clarify various aspects of embodiments of the present disclosure and additional features and advantages of the embodiments, a more particular description of various aspects and features will be rendered by reference to specific embodiments thereof which are illustrated in the appended drawings. It is appreciated that these drawings depict only typical embodiments of the disclosure and are therefore not to be considered limiting its scope, nor are the figures necessarily drawn to scale.

BRIEF DESCRIPTION OF THE SEVERAL VIEWS OF THE DRAWINGS

The embodiments herein will be described and explained with additional specificity and detail through the use of the accompanying drawings in which.

DETAILED DESCRIPTION

Figure 1A:
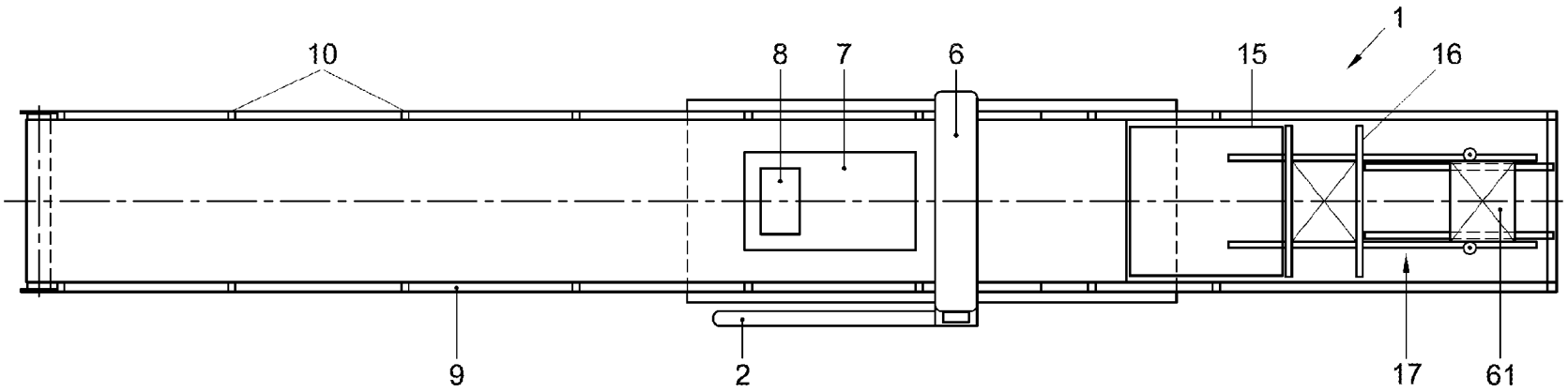
FIG. 1A is a schematic top view of a system 1 for packaging items in a custom sized box in accordance with the invention.
Figure 1B:
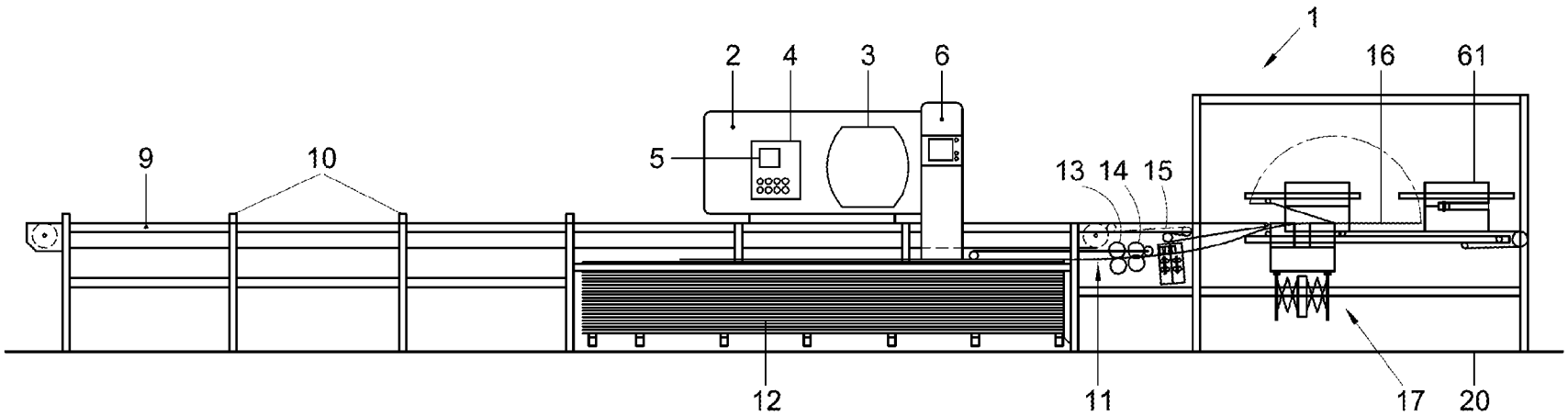
FIG. 1B is a schematic side view of the system shown in FIG. 1A.

In FIG. 1A a schematic top view of a system 1 for packaging items 7, 8 in a custom sized box in accordance with the invention is shown. A schematic side view of the system 1 is shown in FIG. 1B.

The system 1 comprises an operating device 2 comprising a processing unit 3 for controlling the operation of the system 1. The operating device 2 can furthermore comprise a console 4 with control buttons e.g., for manually inputting data and a display 5.

A measurement device 6 is included in the system 1 for measuring the dimensions and optionally weight of items 7, 8 to be packaged and for providing data indicative for the measured dimensions and optionally weight. Such a measurement device 6 measures the length, width and height of the items 7, 8 to be packaged, and such a system is known per se and shall not be described in detail in this disclosure. Devices for measuring weight, e.g., integrated in a transport conveyor are also known per se. The measurement device 6 is communicatively connected to the operating device 2 for providing data indicative for the measured dimensions to the operating device 2. Such a connection can be hardwired or wireless.

The items 7, 8 to be packaged are transported by transport means 9, which can be realized by any known means, such as an endless conveyor belt, a roller conveyor, etc. The transport means 9 can comprise indicators 10 for indication of the location of the items 7, 8 on the transport means 9. Such indicators 10 can be in the form of light sensors, cameras or any other known means. Such indicators 10 can in combination with data from the operating device 2, to which the transport means 9 including the indicators 10 are communicatively connected, also be used to indicate a location on the transport means 9 where items belonging to an order for a customer are to be positioned. Transport of such items belonging to an order can be realized by (not-shown) transport means which e.g., are formed by conveyor belts which are oriented transverse to the transport means 9, and the operation of which can also be controlled by the operating device 2.

The system 1 furthermore comprises a blank forming apparatus 11 for forming a custom sized blank for example out of a stock 12 of default blanks Although the stock 12 of default blanks is shown in FIG. 1B as a stack of default blanks, such a stock may also be provided by an endless material wound on a roll or stocked otherwise. Also the blank forming apparatus 11 is communicatively connected to the operating device 2, which controls the blank forming apparatus 11 for forming a custom sized blank at least based on the data indicative for the measured dimensions as provided by the measurement device 6. The blank forming apparatus 11 comprising score application means 13 for applying score or crease lines as folding lines and cutting means 14 for applying cutouts between the respective panels of a custom sized blank to be formed. As part of the blank forming apparatus 11 the score application means 13 (as well as the cutting means 14) are also communicatively connected to the operating device 2, which controls the operation of score application means 13 and cutting means 14 at least based on the data indicative for the measured dimensions. Transferring means 15 which are included in the system 1 are arranged for transferring a custom sized blank onto a first support surface 16 and are communicatively connected to the operating device 2 which controls the operation of transferring means 15. The transferring means can e.g., be formed by superposed conveyor belts in between which the blank is transferred from the blank forming apparatus 11 to the first support surface 16.

The operating device 2 controls the operation of the relevant devices such that first a custom sized blank is transferred to the first support surface 16 after which the items to be packaged are transported to be positioned on top of the custom sized blank. The transfer preferably takes place such that a centerline of the bottom panel of the custom sized blank is positioned above a centerline of the first support surface and a centerline of a footprint of the items to be packaged is positioned above the centerline of the bottom panel.

According to the invention the first support surface 16 is part of a box folding apparatus 17 for folding a custom sized box from the custom sized blank. Also this box folding apparatus 17 is communicatively connected to the operating device 2 for controlling the operation thereof. The box folding apparatus 17 used in the inventive system 1 will be described in more detail with reference to FIGS. 2A to 2C which schematically show top views in perspective of an embodiment of a box folding apparatus 17 and FIG. 2D which schematically shows a side view in perspective of the box folding apparatus 17.

Figure 2A:
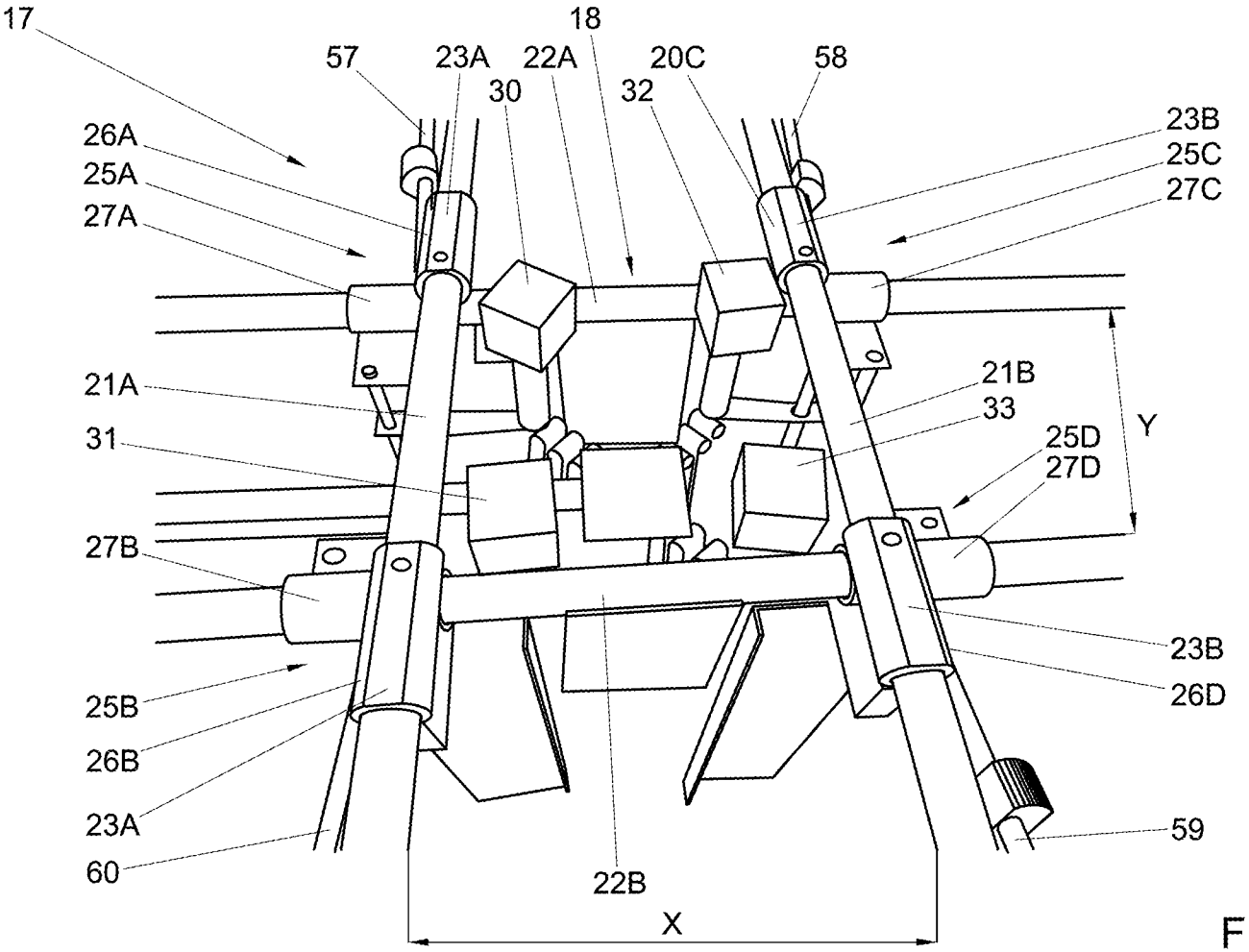
FIGS. 2A to 2C schematically show top views in perspective of an embodiment of a box folding apparatus of a system in accordance with the invention.
Figure 2B:
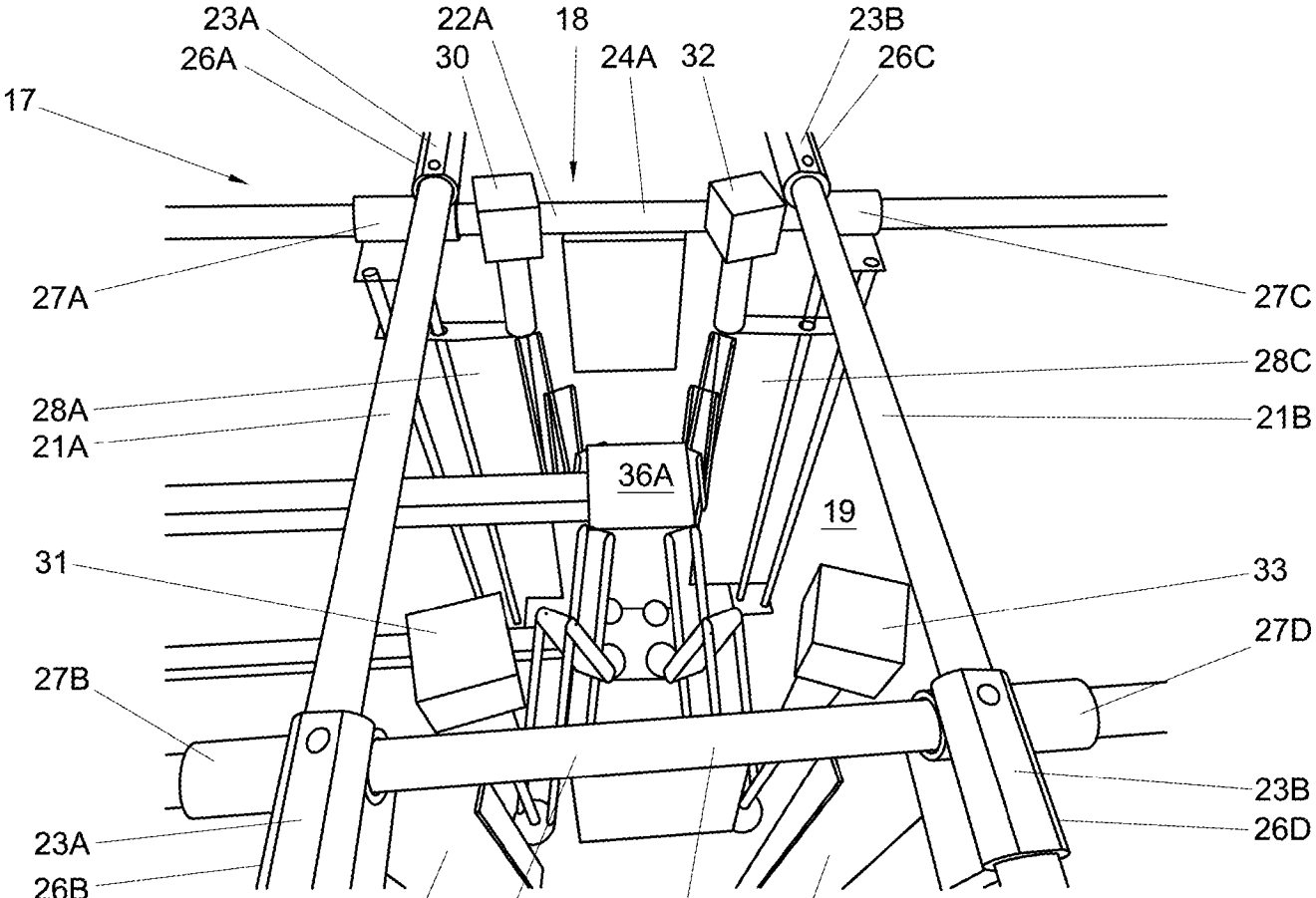

The box folding apparatus 17 comprises a rectangular throat frame 18 having a rectangular throat opening 19 (indicated in FIGS. 2B and C). The throat frame 18 is mounted on a horizontal second support surface 20 (FIG. 1B) which in this embodiment is formed by a floor on which the complete system is supported. The throat frame 18 comprises two transverse folding elements, which in the embodiment shown in the drawings are formed by folding bars 21A, 21B positioned at a first distance X from each other for transversely folding the custom sized blank. Two longitudinal folding bars 22A, 22B are positioned at a second distance Y from each other for longitudinally folding the custom sized blank. The rectangular throat opening 19 is defined by the transverse folding bars 21A, 21B and the longitudinal folding bars 22A, 22B. The transverse folding bars 21A, 21B each have a transverse folding bar top surface 23A, 23B which is positioned at a first height from the floor 20. This first height is in this embodiment larger than a second height at which the longitudinal folding bar top surface 24A, 24B of the longitudinal folding bars 22A, 22B are positioned from the floor 20. This construction makes the uppermost of the top surfaces of the folding bars, i.e., the transverse folding bar top surfaces 23A, 23B are positioned highest and thus these transverse folding bar top surfaces 23A, 23B form the first support surface 16 for supporting the custom sized blank. In this embodiment the transverse 21A, 21B and longitudinal folding bars 22A, 22B are positioned stationary in height with respect to the floor 20. The transverse and longitudinal folding bars completely enclose (or surround) the throat opening 19 and form a closed circumference. In the shown embodiment the transverse folding bar 21A is positioned stationary (or fixed). Please note that in other, non-shown embodiments the folding bars may be replaced by other folding elements, such as folding plates, preferably having rounded edges, or a plurality of adjacent folding elements, as long as the throat frame formed by the folding elements encloses the entire circumference of the throat opening in order to ensure that items to be packaged are confined within the throat frame and even to laterally support the items to be packaged.

Near each corner of the throat frame 18 a corner connection piece 25A-25D is provided which interconnects the transverse folding bars 21A, 21B to the longitudinal folding bars 22A, 22B allowing the folding bars to be displaceable with regard to one another. Each corner connection piece 25A-25D therefore has a transverse sliding sleeve 26A-26D that slidably supports a part of a respective transverse folding bar 21A, 21B and a longitudinal sliding sleeve 27A-27D that slidably supports a part of a respective longitudinal folding bar 22A, 22B.

In the shown embodiment the transverse sliding sleeves 26A-26D project beyond the transverse folding bars 21A, 21B but in an alternative embodiment the transverse folding bars may be constructed such that at the place where the sliding sleeves are mounted they have a reduced diameter, in particular such that the upper surface of the transverse folding bars lies in the same plane as the upper surface of the transverse sliding sleeves. In the meaning of the present disclosure the upper surface of the transverse sliding sleeves is seen as the upper surface of the transverse folding bars. Please note that in alternative, not shown embodiments, different kind of connection pieces can be used.

Figure 2C:
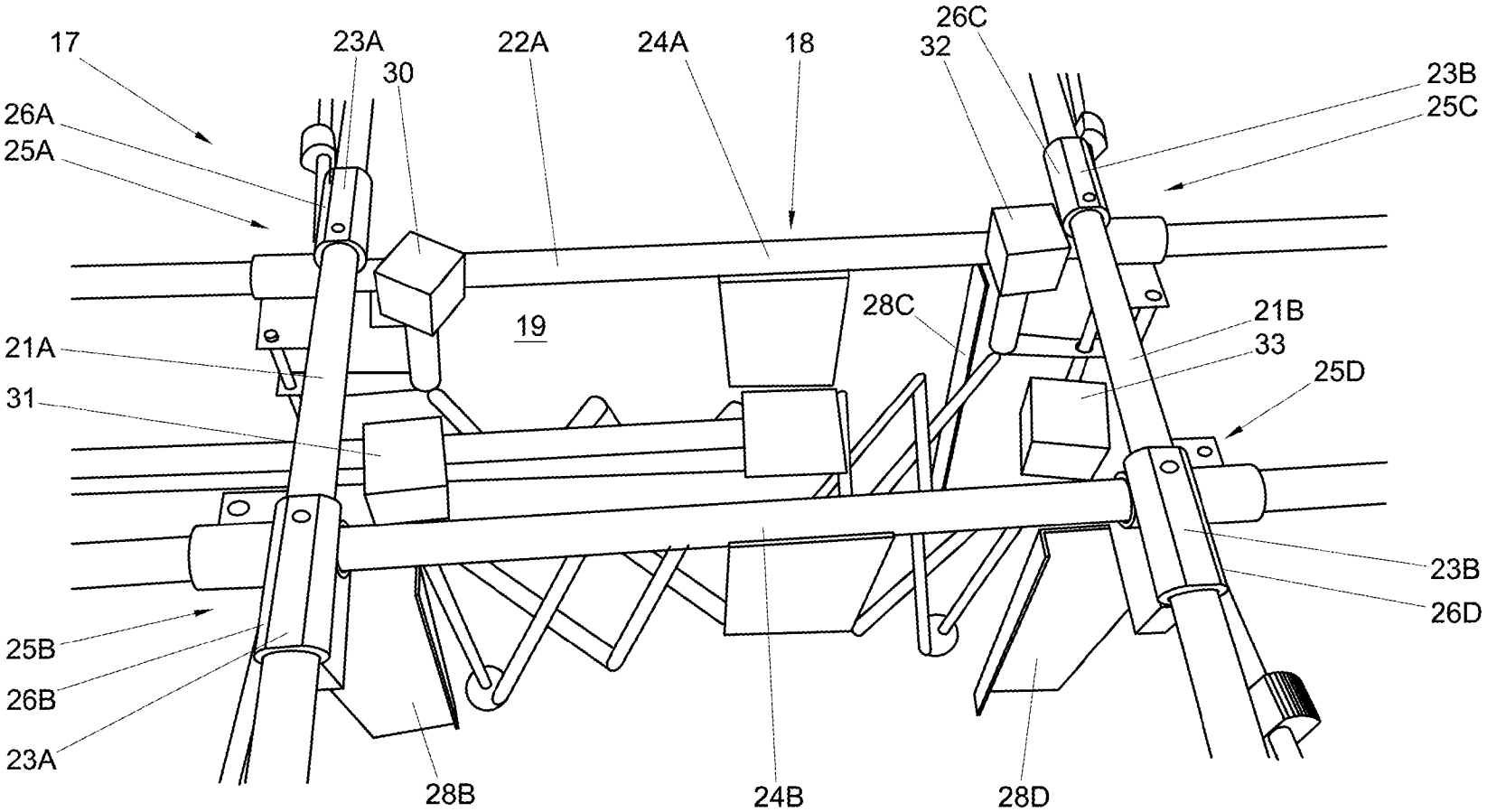

As a result of the slidability of the folding bars with respect to each other the first distance X between the two transverse folding bars 21A, 21B and the second distance Y between the two longitudinal folding bars 22A, 22B are adjustable independent from each other. This is schematically indicated in FIG. 2A, 2B and 2C in which the rectangular throat opening 19 is shown having different dimensions as result of displacement of the folding bars relative to one another. The displacement of the folding bars relative to one another can be effected by any known means, such as electrically, hydraulically or pneumatically driven actuator means, which are communicatively connected to the operating device 2 and which are arranged for adjusting the first distance X and second distance Y at least based on the data indicative for the measured dimensions.

Figure 2D:
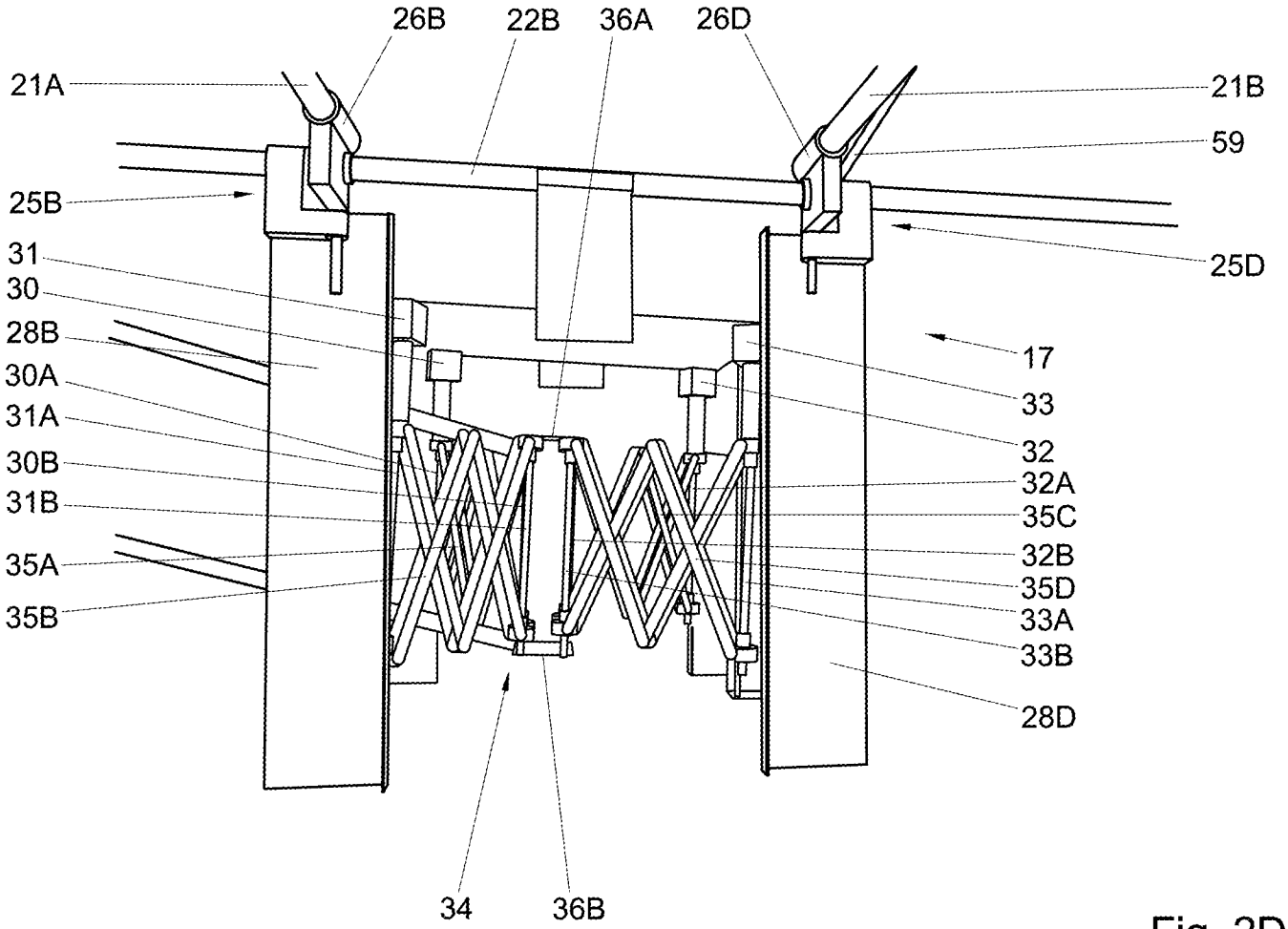
FIG. 2D schematically shows a side view in perspective of the box folding apparatus shown in FIGS. 2A to 2C.

Furthermore each corner connection piece 25A-25D is provided with a vertical support element 28A-28D having an inner guide surface for guiding (part of) the corners of blank during folding as can be seen in FIG. 2D.

The inventive system 1 further comprises a suction device having four suction nozzles 30, 31, 32, 33 each connected to a (non-shown) means for applying underpressure to the suction nozzles. Each of the four suction nozzles 30-33 is in the present embodiment mounted near a respective corner of the rectangular throat opening 19 and is positioned within the rectangular throat opening 19. The suction device including the means for applying underpressure is communicatively connected to the operating device 2 to be controlled thereby. As most clearly can be seen in FIG. 2D each of the suction nozzles 30-33 is slidably mounted on a vertical sliding rod 30A-33A which is attached to a respective vertical support element 28A-28D.

The system 1 is further provided with a displacement device for simultaneously lowering the four suction nozzles 30-33 from a top position (shown in FIGS. 2A to 2C) in which top surfaces of the suction nozzles 30-33 lie in the plane of the first support surface 16 towards a bottom position (as shown in FIGS. 3D to 3G). The displacement device is also arranged for simultaneously raising the four suction nozzles 30-33 from the bottom position to the top position. Any known type of displacement device can be used as long as the displacement device can be communicatively connected to the operating device 2 in order to be controlled thereby. The bottom position is proportional to the measured height of the items to be packaged, such that when the box is in the bottom position the top surface of the transverse folding bars is at the same height or a small amount higher than the upper edge of the end panels, such that transverse folding bars still surround the end panels to provide sufficient lateral support to the box. As can be seen particularly clearly in FIG. 2D the displacement device comprises a central translation construction 34. This central translation construction 34 comprises for each suction nozzle 30-33 a shearing bar construction 35A-35D which is at one end connected to a respective vertical sliding rod 30A-33A and with the other end to a respective, centrally positioned sliding bar 30B-33B. The four centrally positioned sliding bars 30B-33B are fixedly connected to each other by connections plates 36A, 36B. As a result of the shearing bar construction the suction nozzles 30-33 are displaceable with respect to one another in a plane which is parallel to the first support surface. In the embodiment shown in FIGS. 2A to 2D the displacement of the suction nozzles occurs simultaneously with the displacement of the folding bars relative to one another due to the interconnection of the suction nozzles with the corner connection pieces via the vertical support elements 28A-28D. It will be clear for a person skilled in the art that in other embodiments of the invention the vertical and horizontal displacement of the suction nozzles can be obtained with other means.

In the embodiment shown in FIG. 2 each suction nozzle comprises a single suction head. However, in dependence on the size of the blank to be folded each suction nozzle can in other embodiments comprise multiple suction heads and/or additional supporting elements, wherein top surfaces of the additional supporting elements lie in the first support surface 16 when the suction device is positioned in the top position.

The following description relates to an embodiment of a system according to the invention in which custom sized boxed having a closed shape are folded, i.e., comprising a bottom, a top and side walls. In other embodiments the custom sized box to be folded may be a so called open box without a top wall.

Figure 4A:
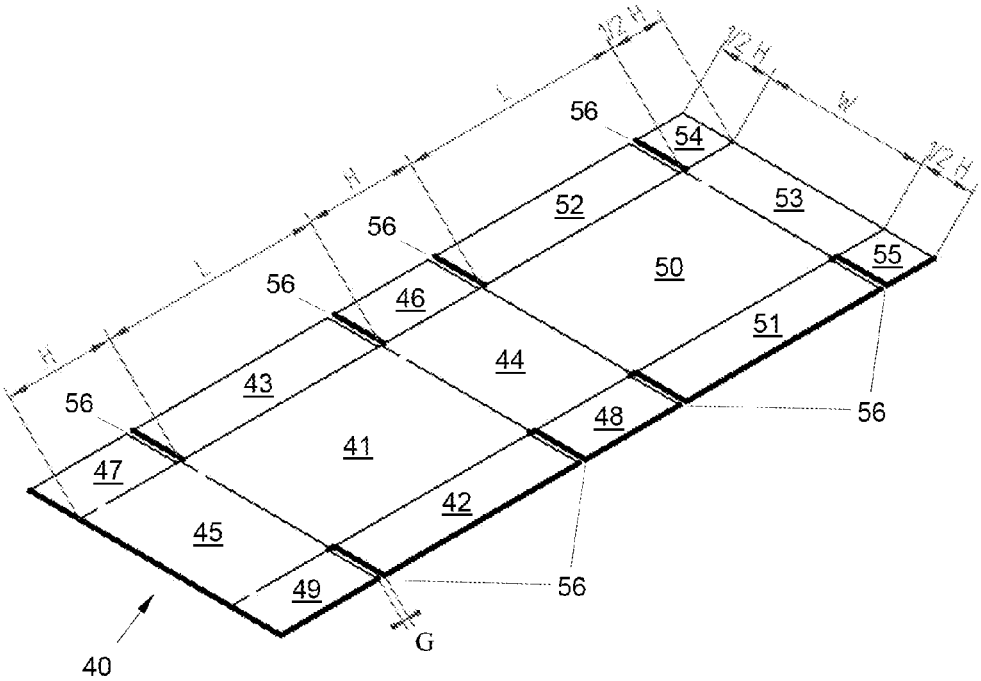
FIGS. 4A to 4F schematically show views in perspective of various stages of folding a custom sized box in which only the blank is shown.

The operating device 2 then controls the blank forming apparatus 11 for forming a custom sized blank 40 (see FIG. 4A) having a rectangular bottom panel 41, rectangular side panels 42, 43 and rectangular end panels 44, 45 joined to the bottom panel 41, rectangular corner panels 46, 48 joined to the end panel 44, rectangular corner panels 47, 49 joined to the end panel 45, a rectangular top panel 50 joined to the end panel 44, rectangular top side panels 51, 52 joined to the top panel 50, a rectangular top end panel 53 joined to the top panel 50 and rectangular top corner panels 54, 55 joined to the top end panel 53. As indicated in FIG. 4A the rectangular bottom panel 41 has a length L and a width W, the rectangular side panels 42, 43 each have a length L and a width ½ H, the rectangular end panels 44, 45 each have a width W and a length H, the rectangular corner panels 46, 48 each have a length H and a width ½ H, the rectangular top panel 50 has a length L and a width W, the rectangular top side panels 51, 52 have a length L and a width ½ H, the rectangular top end panel 53 has a length ½ H and a width W, and the rectangular top corner panels 54, 55 have a width and a length of ½ H. The cutting means 14 provide cutouts 56 between the respective corner panels and the adjoining side panels having a width of ½ H and a length G which is sufficient for allowing a correct folding of the panels with respect to one another. Please note that in dependency of the (stiffness) of the material of which the blanks are made the dimensions can be a little larger (by an amount of a few millimeters) in order to ensure a correct folding of the box while still providing sufficient interior volume of the box. In an alternative embodiment the width of the top side panels and the length of the top end panel is a certain amount, preferably about 1 cm to 2 cm, larger than ½ H so that an overlapping part is obtained, which protects the items to be packaged when a seal of the box is opened.

Figure 3A:
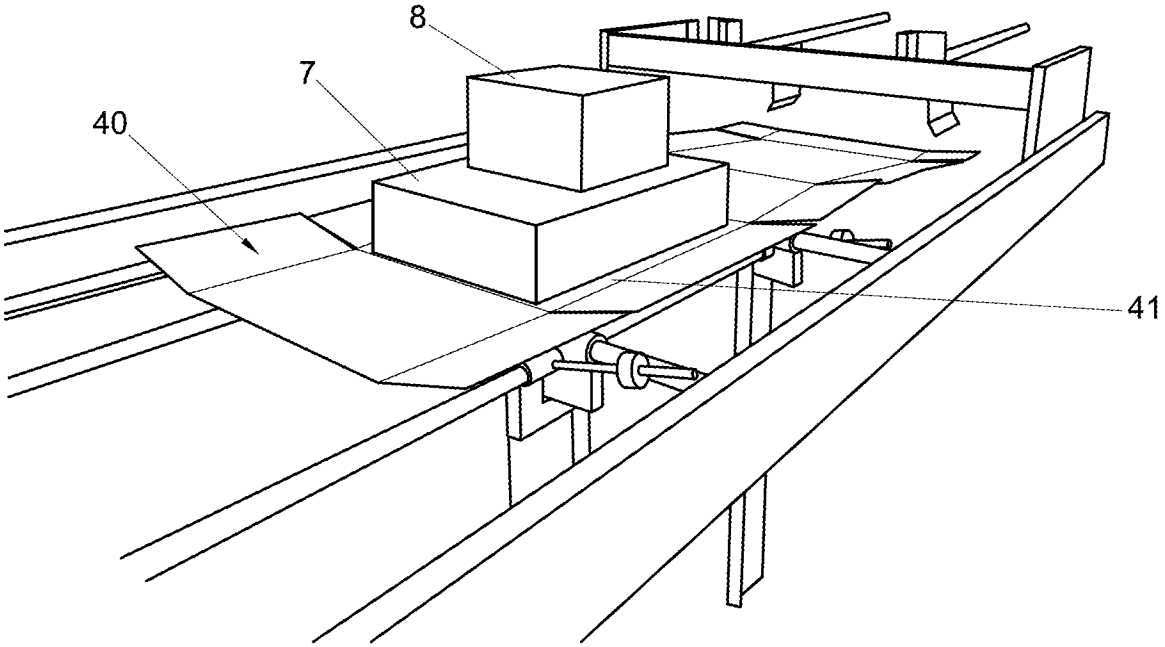
FIGS. 3A to 3J schematically show views in perspective of various stages of folding a custom sized blank with a system in accordance with the invention.

The transferring means 15 of the system 1 are controlled by the operating device 2 for transferring the custom sized blank 40 onto the first support surface 16 formed by the top surfaces of the transverse folding bars and the top surfaces of the suction nozzles, such that the rectangular bottom panel 41 is positioned above the throat opening 19 of the rectangular throat frame 18 as indicated in FIG. 3A. The operating device 2 then controls the displacement device for positioning the suction nozzles in the top position and for activating the suction nozzles for sucking the bottom panel 41 of the custom sized blank 40 to the suction nozzles. The items 7, 8 to be packaged are then transported onto the bottom panel 41. Although the items to be packaged can be transferred onto the bottom panel before the suction nozzles have been activated, placing the items after the suction device has been activated ensures that the position of the bottom panel 41 with regard to the throat frame 18 is not compromised by the transport of the items onto the bottom panel. The position shown in FIG. 3A is the situation just before the folding of the custom sized blank 40 starts.

The system according to the invention ensures a correct order in which the blank is folded by means of corner panel folders 57, 58, 59, 60 mounted near the corners of the throat frame 18 in positions to underlie the corner panels 46-49. The corner panel folders 57-60 are moveable in a plane parallel to the first support surface 16, which in accordance with this embodiment is easily obtained in that each corner panel folder 57-60 is supported by a respective corner connection piece 25A-25D. In this manner the operating device 2 can reproducible move each of the corner panel folders in positions to underlie the corner panels by only controlling the movement of the folding bars relative to one another based on the data indicative for the measured dimensions.

Figure 3B:
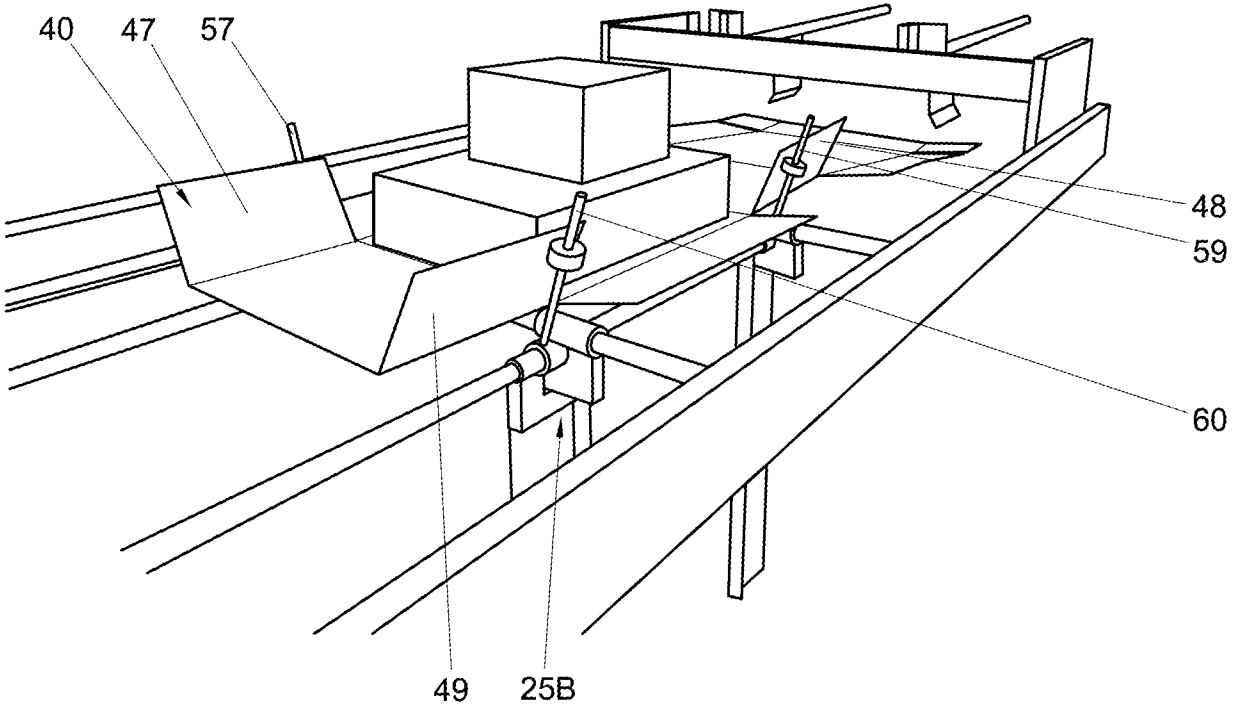

By controlling the upward movements of the corner panel folders 57-60 the operating device 2 can ensure that the corner panels 46-49 are first at least partly folded upwards after the suction nozzles have been activated. The situation in which the corner panels are folded upwards is shown in FIG. 3B.

Figure 3C:
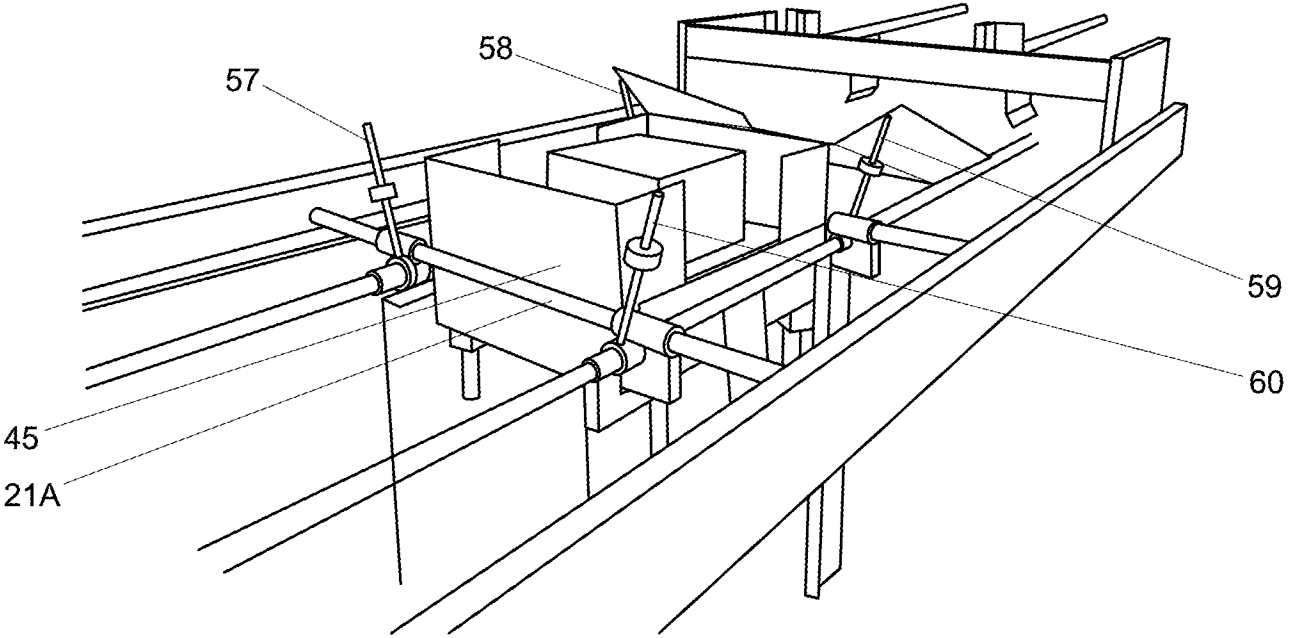
Figure 3D:
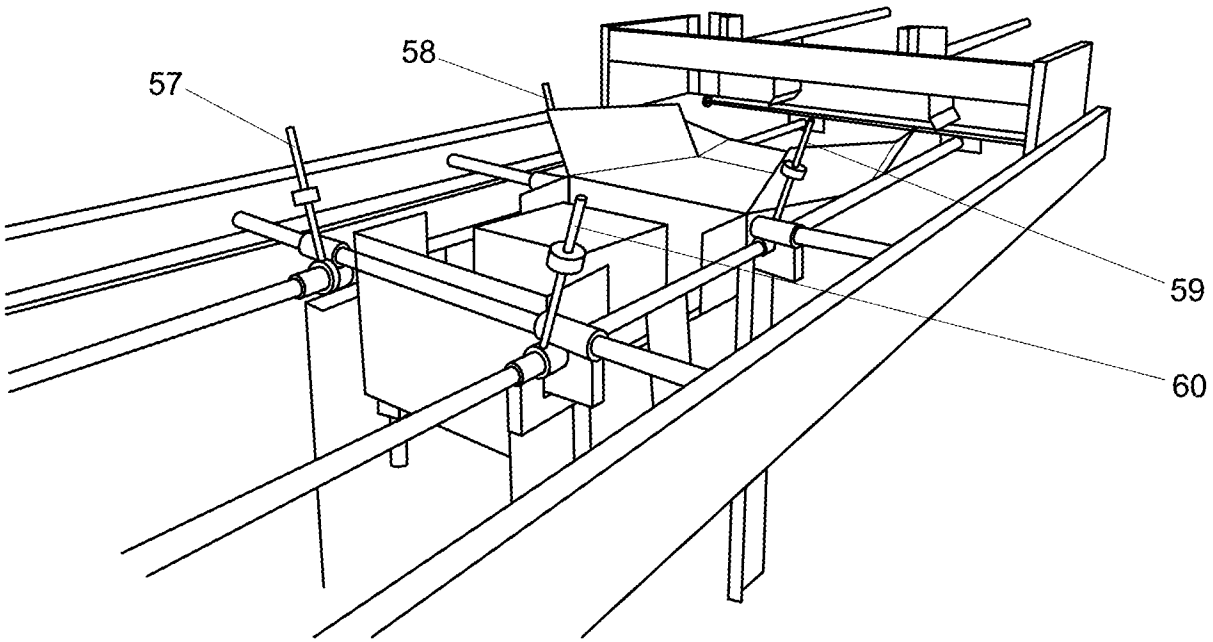
Figure 3E:
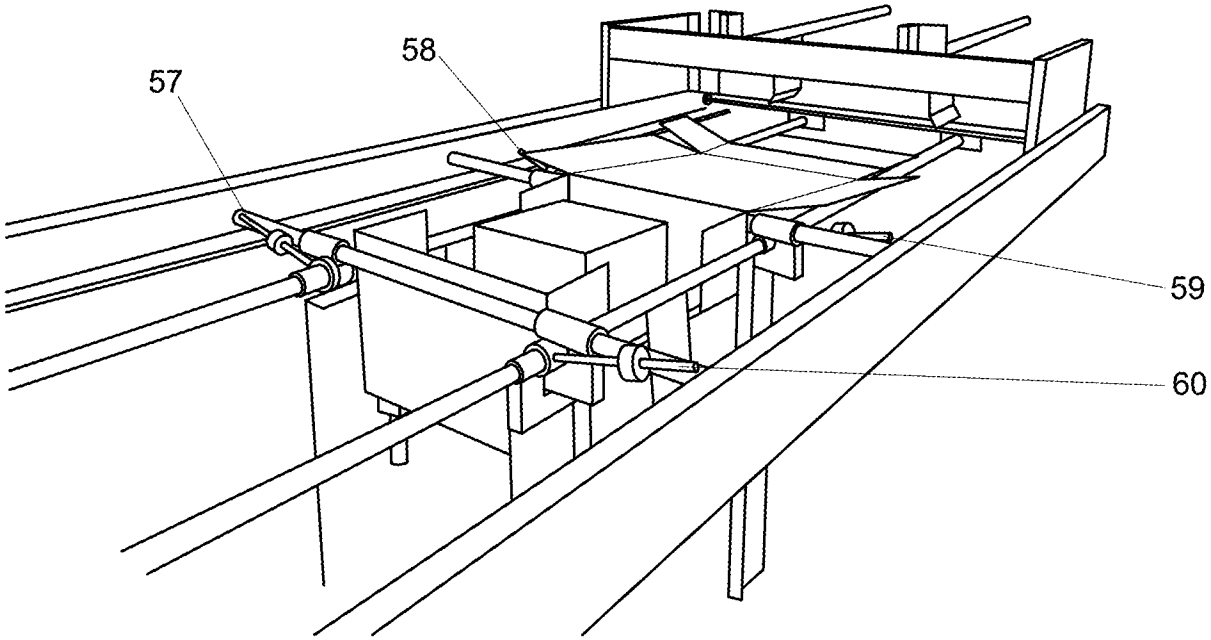
Figure 3F:
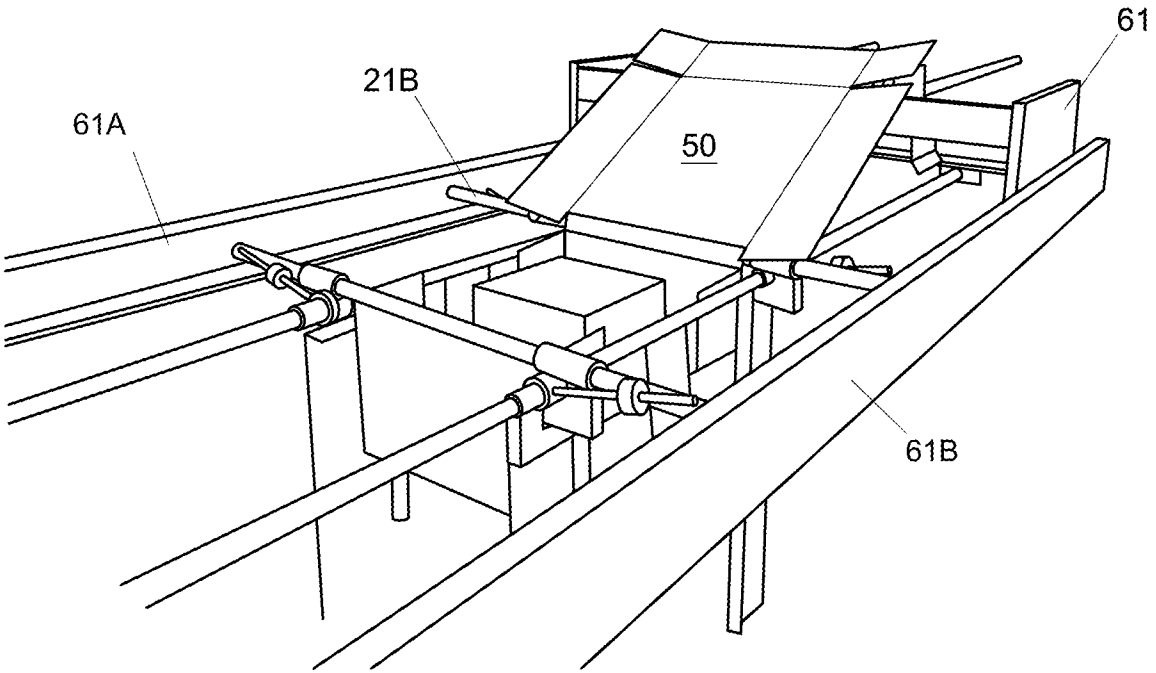

Thereafter the operating device 2 activates the displacement device to lower the suction nozzles, which engage the bottom panel, towards the bottom position. This displacement device can operate in any known manner, such as electrically, pneumatically or hydraulically. Since the transverse folding bars are positioned higher than the longitudinal folding bars first the end panels 44, 45 are caused to be folded upwards and then the side panels 42, 43. This ensures that the side panels 42, 43 are situated at the outside of the corner panels 46-49 as can be seen in FIG. 3C. The displacement device continues to lower the suction device together with the partly folded box until the displacement device reaches an intermediate position just above the bottom position as is shown in FIG. 3D. In this position the corner panel folders 57-60 are lowered into the position shown in FIG. 3E after which the displacement device is lowered to the bottom position causing an initial folding of the rectangular top panel 50 by the transverse folding bar 21B as is indicated in FIG. 3F.

Figure 3G:
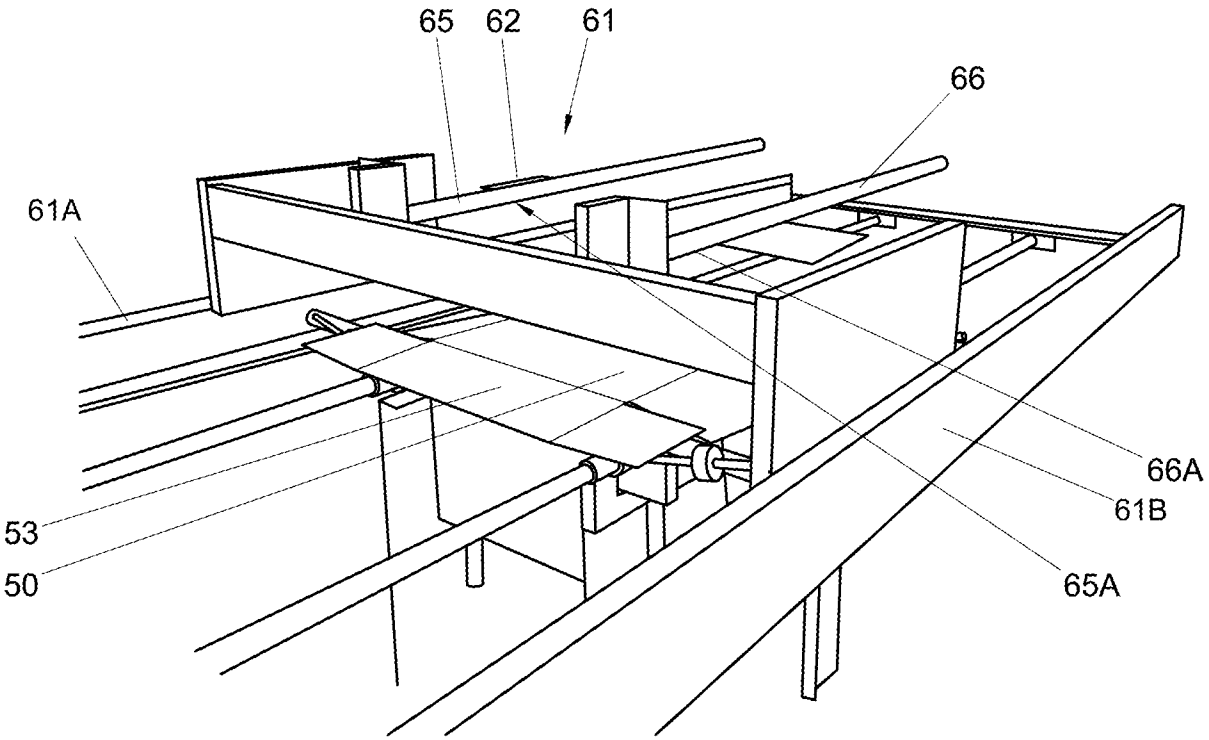

For further folding the top panel 50 over the bottom panel 41 and the erected side panels 42, 43 and end panels 44, 45 a top panel folder 61 is provided. The top panel folder 61 is in this embodiment linearly moveable along a rail construction 61A, 61B (see FIGS. 3F and 3G) which movement is controlled by the operating device 2 after the suction nozzles have reached the bottom position and controlled such that the top panel folder 61 folds the top panel 50 over the bottom panel 41 after the corner panels folders have been moved to a more horizontal position as is shown in FIG. 3G.

Figure 3H:
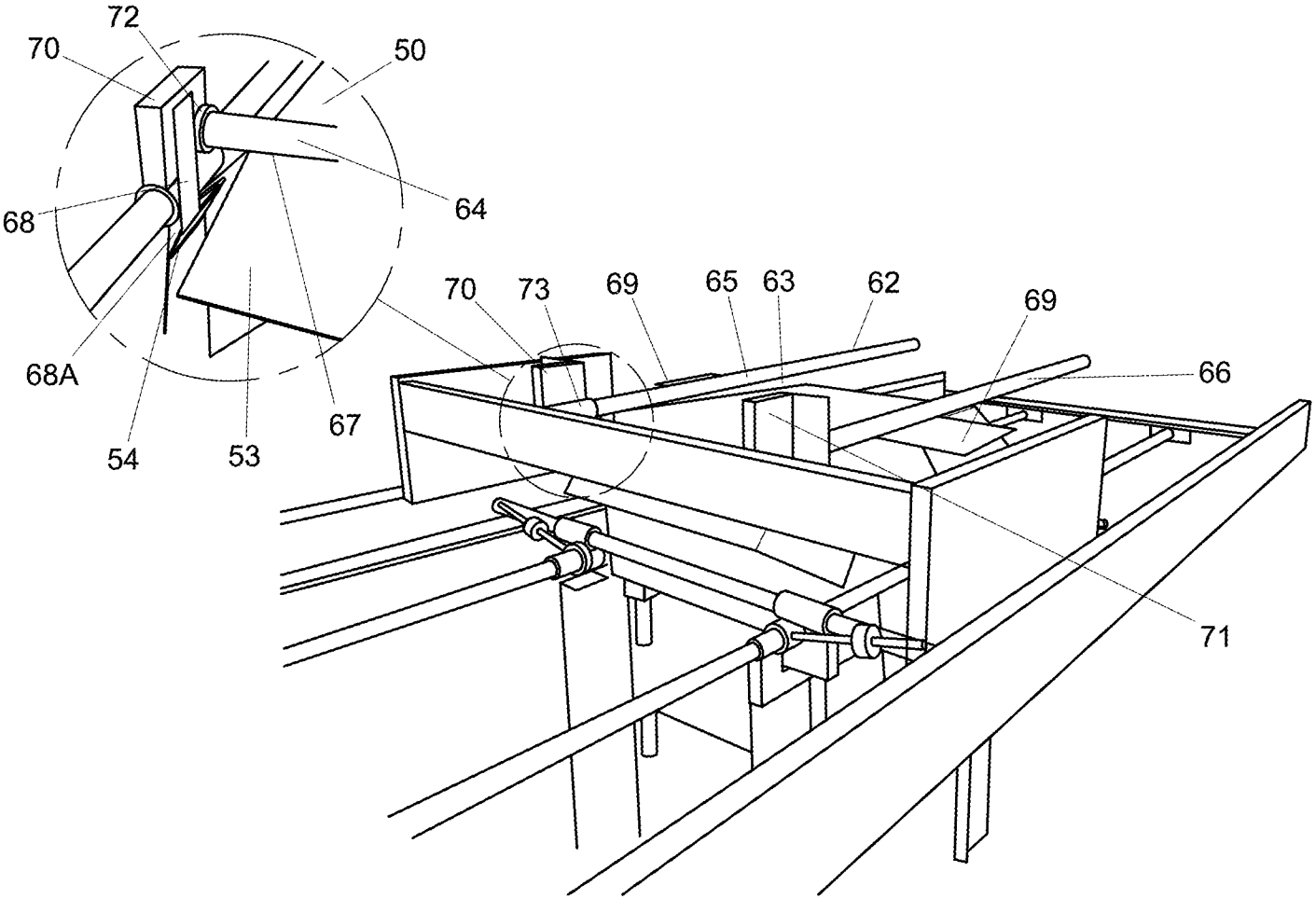

The top panel folder 61 comprises a rectangular upper throat frame 62 having a rectangular upper throat opening 63. The upper throat frame 62 includes one upper transverse folding bar 64 for transversely folding the top panel. In this embodiment a second opposite transverse folding bar needs not to be present since folding of only one top end panel is necessary. Two upper longitudinal folding bars 65, 66 are positioned at the second distance Y from each other for longitudinally folding the top panel. The upper rectangular throat opening 63 is defined by the upper transverse folding bar 64 and the upper longitudinal folding bars 65, 66. The operating device 2 controls the top panel folder 61 such that the upper transverse 64, and upper longitudinal folding bars 65, 66 are positioned right above the transverse folding bar 21A and longitudinal folding bars 22A, 22B after the top panel folder 61 has folded the top panel over the bottom panel and the erected side and end panels, i.e., after the top panel folder 61 has moved in the position as shown in FIG. 3H.

Figure 3I:
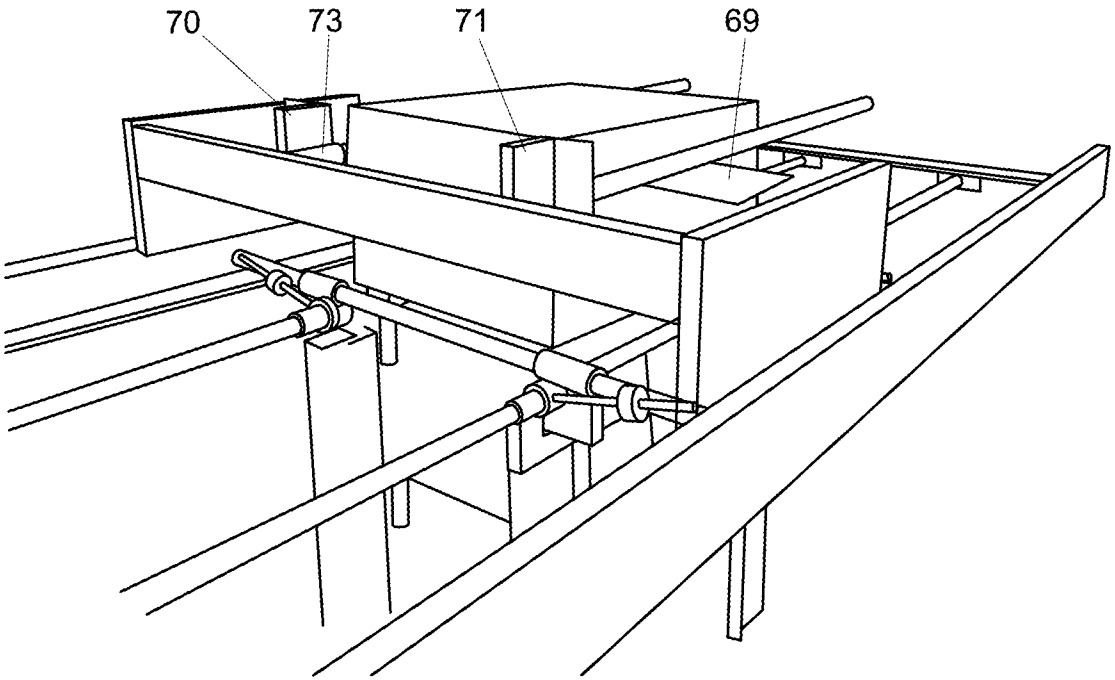
Figure 3J:
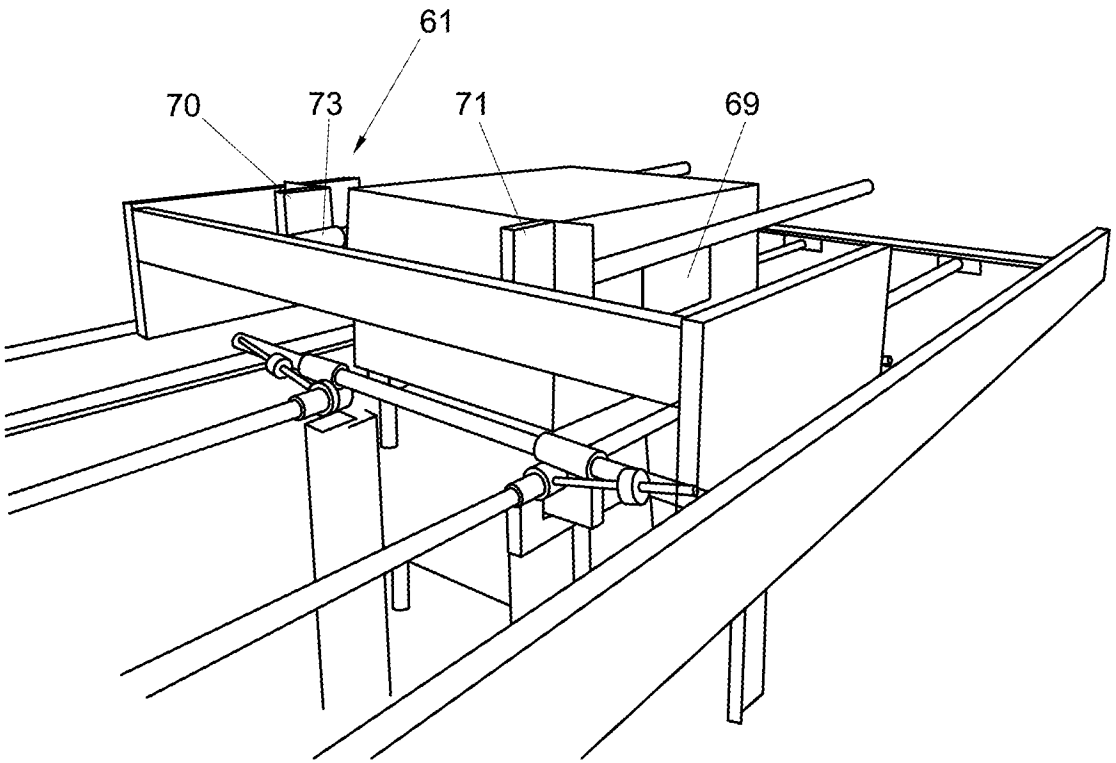

The upper transverse folding bar 64 has an upper transverse folding bar bottom surface 67 which in the folding position of the upper throat frame 62 is positioned at a third height from the floor 20. The upper longitudinal folding bars 65, 66 each have an upper longitudinal folding bar bottom surface 65A, 66A which in the folding position of the throat frame is positioned at a fourth height from the floor 20. In addition the upper throat frame 62 includes two top corner panel folding elements one of which 68 is shown in the insert in FIG. 3H mounted near two corners of the upper throat frame 62 in positions to overlie the respective top corner panels 54, 55. Each of the top corner panel folding elements 68 has a bottom surface 68A which in the folding position of the throat frame is positioned at a fifth height from the floor 20. In the present embodiment the fifth height is smaller than said third height and the third height is smaller than the fourth height, which ensures that during raising of the suction device first the corner panels 54, 55 are (partly) folded, then the top end panel 53 and finally the top side panels 51, 52. In this manner a reproducible folding of the custom sized blank to a closed box which contains the items is produced, as is shown in FIG. 31. In order to keep the folded custom sized box in shape for further processing the top panel folder 61 comprises upper side guides 69 (FIGS. 3H to 3J). In the present embodiment the upper side guides 69 are attached to the upper longitudinal folding bars 65, 66, so that rotation of the upper longitudinal folding bars 65, 66 (under control of the operating device 2) after the folding has been completed until the upper side guides contact the box (see FIG. 3J) guarantees that the box stays in shape.

In analogy with the corner panel folders near the lower throat frame 18 each top corner panel folding element 68 is moveable in a plane parallel to the first support surface 16. This is in accordance with the present embodiment realized in that near each corner of the upper throat frame 62 an upper corner connection piece 70, 71 (see FIGS. 3H to 3J) is provided. Each upper corner connection piece 70, 71 has an upper transverse sliding sleeve 72 slidably supporting a part of the upper transverse folding bar 64 and an upper longitudinal sliding sleeve 73 supporting a part of an upper longitudinal folding bar 65, 66. In the embodiment shown the top corner panel folding elements 68 are supported by a respective upper corner connection piece 70, 71 so that the positioning of the top corner panel folding elements is coupled to the positioning of the upper folding bars as controlled by the operating device 2. This positioning is done in a manner analogous to that for the lower throat frame 18, in that the second distance between the two upper longitudinal folding bars 65, 66 is adjustable and controlled by the operating device at least based on the data indicative for the measured dimensions.

For further processing, for example to transport the box to a taping machine for sealing the box, the top panel folder 61 can be moved linearly away from the throat frame. If desired the box can be taken over by further means controlled by the operating device.

Figure 4B:
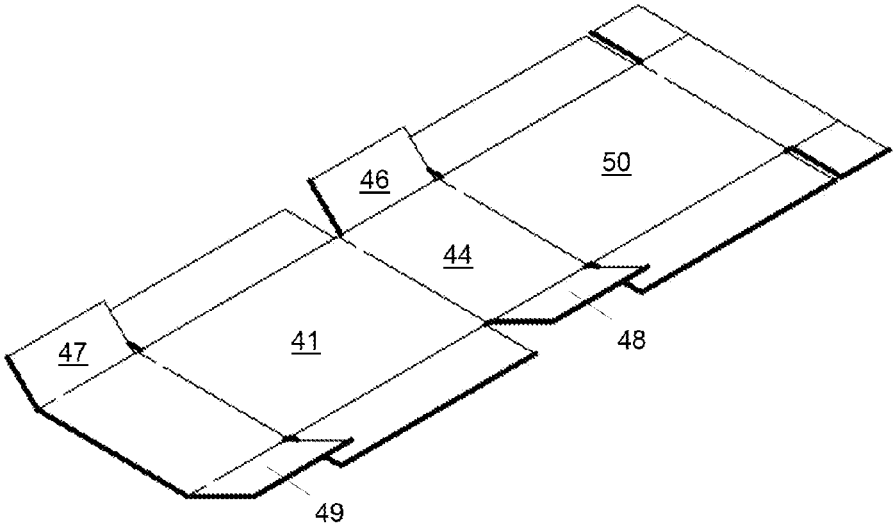
Figure 4C:
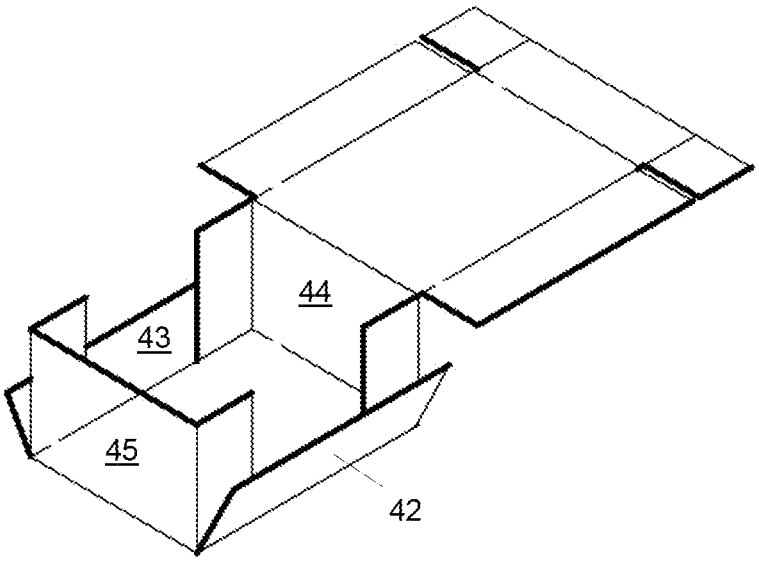
Figure 4D:
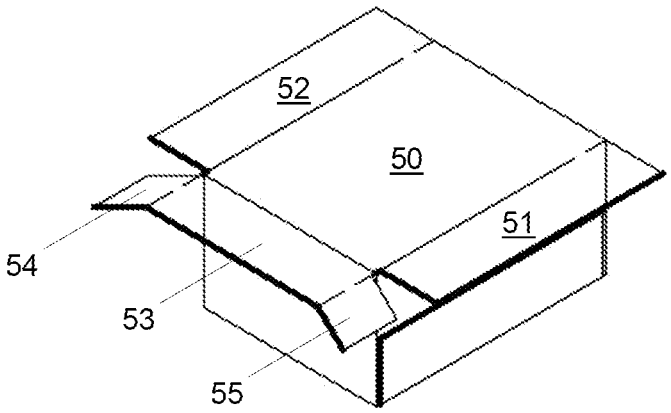
Figure 4E:
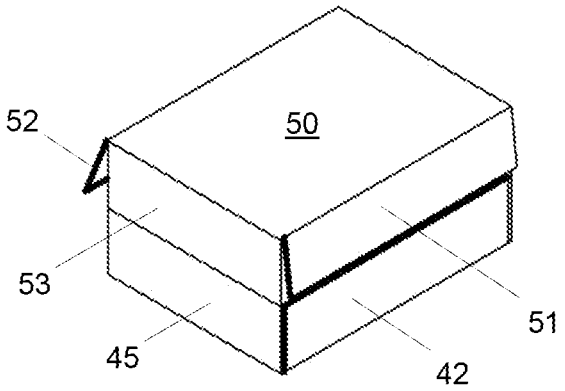
Figure 4F:
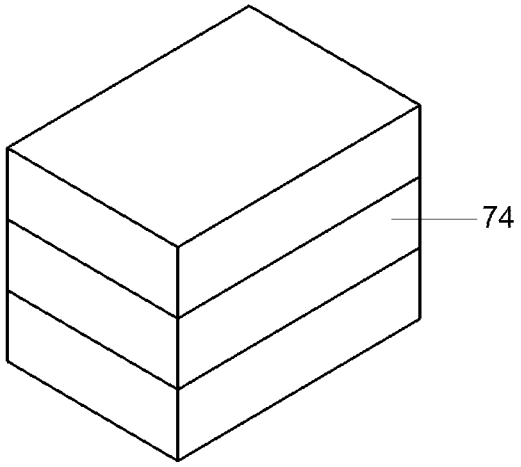

In FIGS. 4A to 4F the different stages of folding of the custom sized blank 40 is shown in which only the blank is shown for clarity. FIG. 4A shows the blank 40 in its flat position as it is positioned on the support plane 16. In FIG. 4B the corner panel folders have partly folded the corner panels upwards. Thereafter first the end panels 44, 45 are folded upwards and then the side panels 42, 43 are folded. In this situation, shown in FIG. 4C the end panels 44, 45 have been erected. Thereafter the top panel 50 is folded over, and the top corner panels are partly folded downwards as shown in FIG. 4D. Next the top end panel and subsequently the top side panels are folded downwards obtaining the custom sized box as indicated in FIG. 4E. As a result of the dimensions of the panels indicated in FIG. 4A there is only one seam which extends around the box at a single height, which makes the application of a single tape 74 around the box to seal the box easily.

Please note that the system can comprise further devices, preferably controlled by the operating device, such as for example: a device for supplying filling material, e.g., shredded paperboard or foam, into the box, for filling up possible empty spaces inside the box; an address printer for printing addresses directly onto the box or on an address sticker, which address sticker is adhered to the box by means of a sticker module; a scale for weighing the box including the items, a franking unit. In addition a wrapping unit may be present to wrap the box into for example gift paper. As an alternative to an applicator for applying tape to the box to seal it, it is possible to use a glue applicator which applies glue to appropriate panels for sealing the box.

The invention claimed is:

1. A system for packaging items in a custom sized box, the system comprising:

an operating device comprising a processing unit for controlling the operation of the system;

a measurement device for measuring the dimensions of items to be packaged and for providing data indicative for the measured dimensions, the measurement device being communicatively connected to the operating device for providing data indicative for the measured dimensions to the operating device;

a blank forming apparatus for forming a custom sized blank, the blank forming apparatus being communicatively connected to the operating device, the operating device controlling the blank forming apparatus for forming a custom sized blank at least based on the data indicative for the measured dimensions, said blank forming apparatus comprising a score application device for applying score lines as folding lines between the respective panels and a cutting device applying cutouts between the respective panels, the score application device being communicatively connected to the operating device, the operating device controlling the operation of the score application device at least based on the data indicative for the measured dimensions;

a box folding apparatus for folding a custom sized box from the custom sized blank, the box folding apparatus being communicatively connected to the operating device, the operating device controlling the box folding apparatus for folding the custom sized box from the custom sized blank; and transport means for transporting the items to be packaged onto the bottom panel of said custom sized box;

characterized in that the box folding apparatus comprises a first support surface for the custom sized blank, the first support surface comprising:

a rectangular throat frame having a rectangular throat opening, in a horizontal plane parallel to the first support surface, the throat frame being mounted on a horizontal second support surface and including two transverse folding elements positioned at a first distance from each other for transversely folding the custom sized blank, and two longitudinal folding elements positioned at a second distance from each other for longitudinally folding the custom sized blank, the transverse and longitudinal folding elements defining the rectangular throat opening and enclosing the entire circumference of the throat opening, the transverse folding elements each having a transverse folding element top surface positioned at a first height from the second support surface and the longitudinal folding elements each having a longitudinal folding element top surface positioned at a second height from the second support surface; the uppermost of the top surfaces forming the first support surface for supporting the custom sized blank; the transverse and longitudinal folding elements being positioned stationary in height with respect to the first support surface; wherein at least one of said first distance and said second distance is adjustable based on the data indicative for the measured dimensions; and in that the box folding apparatus further comprises:

a suction device having suction nozzles, the suction device being communicatively connected to the operating device;

a displacement device for lowering the suction nozzles from a top position in which top surfaces of the suction nozzles are each coplanar with the first support surface towards a bottom position, and for simultaneously raising the suction nozzles from the bottom position to the top position, respectively; the displacement device being communicatively connected to the operating device, the operating device controlling the displacement device for controlling the lowering and raising of the suction nozzles, respectively;

the operating device controlling the blank forming apparatus for forming a custom sized blank having at least a rectangular bottom panel, rectangular side panels and rectangular end panels joined to the bottom panel, and rectangular corner panels joined to the end panels; the operating device controlling the displacement device for positioning the suction nozzles in the top position and for activating the suction nozzles for sucking the bottom panel of the custom sized blank to the suction nozzles; and for thereafter lowering the suction nozzles towards the bottom position thereby causing folding of the side and end panels with respect to the bottom panel.

2. A system for packaging items in a custom sized box according to claim 1, wherein the operating device is arranged for adjusting the first and second distance at least based on the data indicative for the measured dimensions.

3. A system for packaging items in a custom sized box according to claim 1, wherein near each corner of the throat frame a corner connection piece is provided, each corner connection piece having a transverse sliding sleeve slidably supporting a part of a transverse folding element and a longitudinal sliding sleeve slidably supporting a part of a longitudinal folding element.

4. A system for packaging items in a custom sized box according to claim 3, wherein each corner connection piece is provided with a vertical support element having a guide surface.

5. A system for packaging items in a custom sized box according to claim 1, wherein the suction nozzles are displaceable with respect to one another in a plane which is parallel to the first support surface.

6. A system for packaging items in a custom sized box according to claim 1, wherein each of the suction nozzles is slidably mounted on a vertical sliding rod mounted to a respective vertical support element.

7. A system for packaging items in a custom sized box according to claim 1, wherein the displacement device comprises a central translation construction, the central translation construction comprising for each suction nozzle a shearing element construction which is at one end connected to a respective sliding rod and with the other end to a respective, centrally positioned sliding element, the four centrally positioned sliding elements being fixedly connected to each other.

8. A system for packaging items in a custom sized box according to claim 1, wherein each of the suction nozzles comprises multiple suction heads and/or additional supporting elements.

9. A system for packaging items in a custom sized box according to claim 1, wherein the system is further provided with corner panel folders mounted near the corners of the throat frame in positions to underlie the corner panels respectively, the operating device controlling the corner panel folders for folding the corner panels at least partly upwards after the suction nozzles have been activated for sucking the bottom panel of the custom sized blank to the suction nozzles and before the suction nozzles are lowered towards the bottom position.

10. A system for packaging items in a custom sized box according to claim 1, wherein the first height at which the transverse folding element top surface is positioned from the second support surface is larger than the second height at which the longitudinal folding element top surface is positioned from the second support surface.

11. A system for packaging items in a custom sized box according to claim 1, wherein the operating device controls the blank forming apparatus for forming a custom sized blank having a rectangular bottom panel, rectangular side panels and rectangular end panels joined to the bottom panel, rectangular corner panels joined to the end panels, a rectangular top panel joined to one of the end panels, rectangular top side panels joined to the top panel, a rectangular top end panel joined to the top panel and rectangular top corner panels joined to the top end panel.

12. A system for packaging items in a custom sized box according to claim 11, wherein the operating device controls the displacement device for further lowering the suction nozzles towards the bottom position thereby causing an initial folding of the rectangular top panel.

13. A system for packaging items in a custom sized box according to claim 11, wherein the system is further provided with a top panel folder for folding the top panel over the bottom panel and the erected side and end panels, the operating device controlling the top panel folder for folding the top panel after the suction nozzles have reached the bottom position.

14. A system for packaging items in a custom sized box according to claim 13, wherein the top panel folder comprises a rectangular upper throat frame having a rectangular upper throat opening, the upper throat frame including at least one upper transverse folding element for transversely folding the top panel, two upper longitudinal folding elements positioned at the second distance from each other for longitudinally folding the top panel, the upper transverse and longitudinal folding elements defining the upper rectangular throat opening, the operating device controlling the top panel folder for positioning the upper throat frame in a folding position in which the upper transverse and longitudinal folding elements are positioned above the transverse and longitudinal folding elements after the top panel folder has folded the top panel over the bottom panel and the erected side and end panels, the upper transverse folding element having an upper transverse folding element bottom surface which in the folding position of the throat frame is positioned at a third height from the second support surface, the upper longitudinal folding elements each having an upper longitudinal folding element bottom surface which in the folding position of the throat frame is positioned at a fourth height from the second support surface; the operating device controlling the displacement device for raising the suction nozzles after the upper throat frame has been positioned in the folding position.

15. A system for packaging items in a custom sized box according to claim 14, wherein the upper throat frame includes two top corner panel folding elements mounted near two corners of the upper throat frame in positions to overlie the two top corner panels respectively, each of the top corner panel folding elements having a bottom surface which in the folding position of the throat frame is positioned at a fifth height from the second support surface, said fifth height being smaller than said third height and the third height being smaller than the fourth height.

16. A system for packaging items in a custom sized box according to claim 14, wherein near each corner of the upper throat frame an upper corner connection piece is provided, each corner connection piece having an upper transverse sliding sleeve slidably supporting a part of the upper transverse folding element and an upper longitudinal sliding sleeve supporting a part of an upper longitudinal folding element.

17. A system for packaging items in a custom sized box according to claim 14, wherein the second distance between the two upper longitudinal folding elements is adjustable, and wherein the operating device is arranged for adjusting the second distance at least based on the data indicative for the measured dimensions.

18. A system according to claim 11, wherein the top panel folder comprises upper side guides for keeping a folded custom sized box in shape.

19. A system for packaging items in a custom sized box according to claim 11, wherein the operating device controls the blank forming apparatus for forming a custom sized blank in which the rectangular bottom panel has a length L and a width W, the rectangular side panels each have a length L and a width ½ H and the rectangular end panels each have a width W and a length H, the rectangular corner panels each have a length H and a width ½ H, the rectangular top panel has a length L and a width W, the rectangular top side panels have a length L and a width ½ H, the rectangular top end panel has a length ½ H and a width W, and the rectangular top corner panels have a width and a length of ½ H.

20. A system for packaging items in a custom sized box according to claim 19, wherein the system comprises cutting means for providing cutouts between the corner panels and the adjoining side panels having a width of ½ H, the cutting means being communicatively connected to the operating device, the operating device controlling the operation of the cutting means at least based on the data indicative for the measured dimensions.

21. A system for packaging items in a custom sized box according to claim 1, wherein the system comprises transferring means for transferring a custom sized blank onto the first support surface and for positioning the rectangular bottom panel above the throat opening of the rectangular throat frame, the transferring means being communicatively connected to the operating device, the operating device controlling the operation of transferring means.

22. A system for packaging items in a custom sized box according to claim 1, wherein the transport means are communicatively connected to the operating device, the operating device being arranged for controlling the operation of transport means for transporting items of which the dimensions have been measured onto the bottom panel after the suction nozzles have been positioned in the top position and before the operating device controls the displacement device for lowering the suction nozzles.

* * * * *